US012630937B2

(12) United States Patent
Usman et al.

(10) Patent No.: US 12,630,937 B2
(45) Date of Patent: May 19, 2026

(54) BISMUTH-ZINC BASED ELECTROCATALYST FOR CONVERSION OF CARBON DIOXIDE TO LIQUID FUELS

(71) Applicant: KING FAHD UNIVERSITY OF PETROLEUM AND MINERALS, Dhahran (SA)

(72) Inventors: Muhammad Usman, Dhahran (SA); Munzir Hamedelniel Mohamed Suliman, Dhahran (SA); Zain Hassan Abdallah Yamani, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 18/944,993

(22) Filed: Nov. 12, 2024

(65) Prior Publication Data

US 2026/0132527 A1 May 14, 2026

(30) Foreign Application Priority Data

Nov. 10, 2024 (SA) ..... 1020246295

(51) Int. Cl.

| | |
|---|---|
| ***C25B 11/06*** | (2006.01) |
| ***C25B 1/23*** | (2021.01) |
| ***C25B 3/07*** | (2021.01) |
| ***C25B 3/26*** | (2021.01) |
| ***C25B 9/01*** | (2021.01) |
| ***C25B 9/15*** | (2021.01) |
| ***C25B 11/052*** | (2021.01) |
| ***C25B 11/065*** | (2021.01) |
| ***C25B 11/095*** | (2021.01) |

(52) U.S. Cl.

CPC ..... *C25B 11/095* (2021.01); *C25B 1/23* (2021.01); *C25B 3/07* (2021.01); *C25B 3/26* (2021.01); *C25B 9/01* (2021.01); *C25B 9/15* (2021.01); *C25B 11/052* (2021.01); *C25B 11/065* (2021.01)

(58) Field of Classification Search

None

See application file for complete search history.

(56) References Cited

FOREIGN PATENT DOCUMENTS

| | | | | |
|---|---|---|---|---|
| CN | 108832110 A | * | 11/2018 | ..... B82Y 30/00 |
| CN | 109930165 A | | 6/2019 | |
| CN | 113265677 A | | 8/2021 | |
| CN | 116695170 A | | 9/2023 | |
| CN | 116903880 A | | 10/2023 | |

* cited by examiner

*Primary Examiner* — Daniel Berns

(74) *Attorney, Agent, or Firm* — Oblon, McClelland, Maier & Neustadt, L.L.P.

(57) ABSTRACT

An electrocatalyst comprising bismuth nanodot-doped zinc materials is used for electrochemical reduction of carbon dioxide to formate. The electrocatalyst consists of bismuth nanodots dispersed on a zeolitic imidazolate framework-8 wherein the bismuth-zinc material is in the form of particles with a longest dimension of 200 to 1000 nm. The bismuth-zinc material is utilized in H cell, flow cell, and MEA cell applications for carbon dioxide reduction.

20 Claims, 22 Drawing Sheets

BISMUTH-ZINC BASED ELECTROCATALYST FOR CONVERSION OF CARBON DIOXIDE TO LIQUID FUELS

CROSS-REFERENCE TO RELATED APPLICATION

The present disclosure claims the benefit of Saudi Patent Application No. 1020246295 filed on Nov. 10, 2024, with the Saudi Authority for Intellectual Property Office, which is incorporated herein by reference in its entirety.

BACKGROUND

Technical Field

The present disclosure is directed to electrocatalysts and, more particularly, toward a bismuth nanodot-doped electrocatalyst for the electrochemical reduction of carbon dioxide to liquid fuels.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present disclosure.

Electrochemical reduction of carbon dioxide, also known as a carbon dioxide reduction reaction ($CO_2RR$), is the conversion of carbon dioxide (CO2) to further reduced chemical species with the use of electrical energy. Carbon dioxide reduction reactions represent a step in the scheme of carbon capture and utilization. Elevated atmospheric $CO_2$ levels, now around 410 ppm, are causing apprehension and prompting government targets and scientific endeavors to remove, reduce, reuse, and recycle $CO_2$ emissions. Among efforts, electrochemical carbon dioxide reduction reactions are changing chemical and fuel production while aiding in mitigating climate change.

Electrochemical $CO_2RR$ can produce diverse compounds, such as formate (HCOO—), carbon monoxide (CO), methane (CH4), ethylene (C2H4), and ethanol (C2H5OH). When comparing the products of $CO_2RR$ in the gas phase with those in liquid form, it is seen that liquid products, such as formate, provide enhanced benefits because of their large energy densities and convenient storage and distribution. Formic acid (HCOOH) fuel produced by $CO_2RR$ is the most profitable resource produced per mole of electrons. Around 800,000 metric tons of formic acid are manufactured annually for various purposes, like chemical manufacturing, sanitation, textile industries, and antiseptics. Formic acid has emerged as a compelling hydrogen carrier due to its ability to remain in liquid form at atmospheric temperatures and pressures, its high hydrogen density (53 g $H_2$ per liter of HCOOH), and its low toxicity. The production of this large energy carrier using electrochemical $CO_2RR$ would reduce carbon emissions and render it as a carbon-neutral liquid fuel; however, converting $CO_2$ to liquid fuels via electrochemical $CO_2RR$ face several obstacles, including limited $CO_2$ solubility, inadequate product selectivity, and difficulty separating products from liquid electrolytes, such as a $KHCO_3$ solution. Due to the current limitations of traditional $CO_2$ electrolyzers and $CO_2RR$ catalysts, products are formed in low concentrations and mixed with impurities.

The unavailability of selective electrocatalysts hinders large-scale applications of $CO_2RR$. Insights into the catalytic mechanisms may contribute to designing efficient electrocatalysts to direct the reaction toward the favored products.

Reticular materials, including metal-organic frameworks (MOFs), covalent organic frameworks, and organic functionalized metals, have revealed promise for $CO_2$ electrocatalysis [Diercks, C. S. et al., The role of reticular chemistry in the design of $CO_2$ reduction catalysts, *Nat Mater.,* 2018, 17, 301]. MOFs, having an expanded porous compositions and coordination systems, can facilitate mass transfer in catalysis and have been used as $CO_2$ adsorbents. ZIF-8 has garnered interest in energy conversion applications due to its structures, stability, conductivity, and large surface area. Utilizing a ZIF-8 support can inhibit metal nanoparticle aggregation, improve the conductive network, and boost interfacial contact. This results in a higher concentration of active sites, which improves the catalytic efficiency of metal nanoparticles. Imidazole-containing ligand-metal coordination enhances charge density, improving its capacity to bind and activate $CO_2$ for reduction. Metal-based nanoparticles can lead to improved catalytic efficiency in reducing $CO_2$ [Cho, J. H. et al., Transition Metal Ion Doping on ZIF-8 Enhances the Electrochemical $CO_2$ Reduction Reaction, *Adv Mater.,* 2023, 35, 2208224]. For example, bismuth, ZIFs, and organic ligand functionalization have been used in electrocatalytic systems for carbon dioxide reduction reactions [Jiang, Z. et al., A Bismuth-Based Zeolitic Organic Framework with Coordination-Linked Metal Cages for Efficient Electrocatalytic $CO_2$ Reduction to HCOOH, *Angewandte Chemie International Edition,* 2023, 62]. Conventionally used catalysts may be unfit for $CO_2RR$ because they promote hydrogen evolution. Electrocatalysts selective for formate include tin or bismuth and silver or gold for carbon monoxide. Copper produces multiple reduced products such as methane, ethylene, or ethanol, while methanol, propanol, and 1-butanol have also been made in minute quantities.

Although metal-doped ZIFs have been developed in the past, there still exists a need to develop efficient and electrocatalysts that contribute to sustainable and large-scale carbon dioxide reduction reactions. Accordingly, an object of the present disclosure is to provide a bismuth-supported zinc material catalyst with good activity and selectivity for formate synthesis in $CO_2RR$ that may overcome the limitations of the art.

SUMMARY

In an exemplary embodiment, bismuth nanoparticles doped in a zinc material is disclosed. The bismuth-zinc material comprises bismuth nanodots and a zeolitic imidazolate framework-8. The bismuth nanodots are dispersed on the zeolitic imidazolate framework-8. The bismuth-zinc material is in the form of particles having a the longest dimension of 200 to 1000 nm. Bismuth is present in an amount of 7 to 8 percent by weight (wt. %) based on the total weight of the bismuth-zinc material. Zinc is present in an amount of 9 to 10 percent by weight (wt. %) based on a total weight of the bismuth-zinc material.

In some embodiments, the bismuth-zinc material is made by a method that involves dissolving a zinc salt in water to form a zinc solution. Dissolving a bismuth salt in water to form a bismuth solution. The method further includes dissolving 2-methylimidazole in water to form a ligand solution. and the method includes mixing the zinc solution and the bismuth solution to form a metal solution. The method includes mixing the ligand solution and the metal solution, adding a base, stirring and, collecting the formed bismuth-zinc material.

In some embodiments, a method of carbon dioxide reduction is described. The method involves contacting a working electrode comprising the bismuth-zinc material, a reference electrode, and a counter electrode with an aqueous solution in a cell, applying a potential and reducing carbon dioxide at the working electrode.

In some embodiments, the working electrode further comprises a carbon paper and a sulfonated tetrafluoroethylene-based fluoropolymer-copolymer.

In another exemplary embodiment, the working electrode is made by a method that involves dispersing the bismuth-zinc material, the sulfonated tetrafluoroethylene-based fluoropolymer-copolymer, and a polar solvent in water to form a mixture. The method includes sonicating the mixture for 10 to 30 minutes and depositing the mixture onto the carbon paper.

In some embodiments, the reference electrode is a silver/silver chloride (Ag/AgCl) electrode.

In some embodiments, the counter electrode is a platinum mesh.

In some embodiments, the aqueous solution comprises potassium bicarbonate.

In some embodiments, the aqueous solution comprises potassium hydroxide.

In some embodiments, the cell is an H-type cell, and the working electrode has a Faradaic efficiency of 50 to 70% for formic acid conversion from carbon dioxide based on an initial amount of carbon dioxide at a potential of −1.3 V vs. RHE and a current density of 50 mA/cm$^2$.

In another embodiment, the cell is an H-type cell, and the working electrode has a Faradaic efficiency of 40 to 50% for formic acid conversion from carbon dioxide based on an initial amount of carbon dioxide at a potential of −1.5 V vs. RHE.

In some embodiments, the cell is an H-type cell, and the working electrode has a Faradaic efficiency of 40 to 60% for carbon monoxide conversion from carbon dioxide based on an initial amount of carbon dioxide at a potential of −0.7 V vs. RHE.

In some embodiments, the cell is a flow cell, and the working electrode has a Faradaic efficiency of 75 to 85% for formic acid conversion from carbon dioxide based on an initial amount of carbon dioxide at a potential of −1.1 V vs. RHE and a current density of 120 mA/cm$^2$.

In some embodiments, the cell is a membrane electrode assembly (MEA) cell, and the working electrode has a Faradaic efficiency of 85 to 95% for formic acid conversion from carbon dioxide based on an initial amount of carbon dioxide at a potential of −1.1 V vs. RHE and a current density of 150 mA/cm$^2$.

In some embodiments, the working electrode has a charge transfer resistance of 5 to 15 Ω/cm$^2$.

In some embodiments, the working electrode has a double layer capacitance of 5 to 15 mF/cm$^2$.

In some embodiments, the cell is a flow cell, and the working electrode has a Tafel slope of 30 to 50 mV/dec.

In some embodiments, the cell is an H-type cell, and the working electrode has a current density of −70 to −50 mA/cm$^2$ at a potential of −1.5 V vs. RHE.

In some embodiments, the cell is a flow cell, and the working electrode has a current density of −260 to −240 mA/cm$^2$ at a potential of −1.5 V vs. RHE.

In some embodiments, the cell is a flow cell, and the working electrode is stable for 10 to 18 hours at a current density of −120 mA/cm$^2$.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
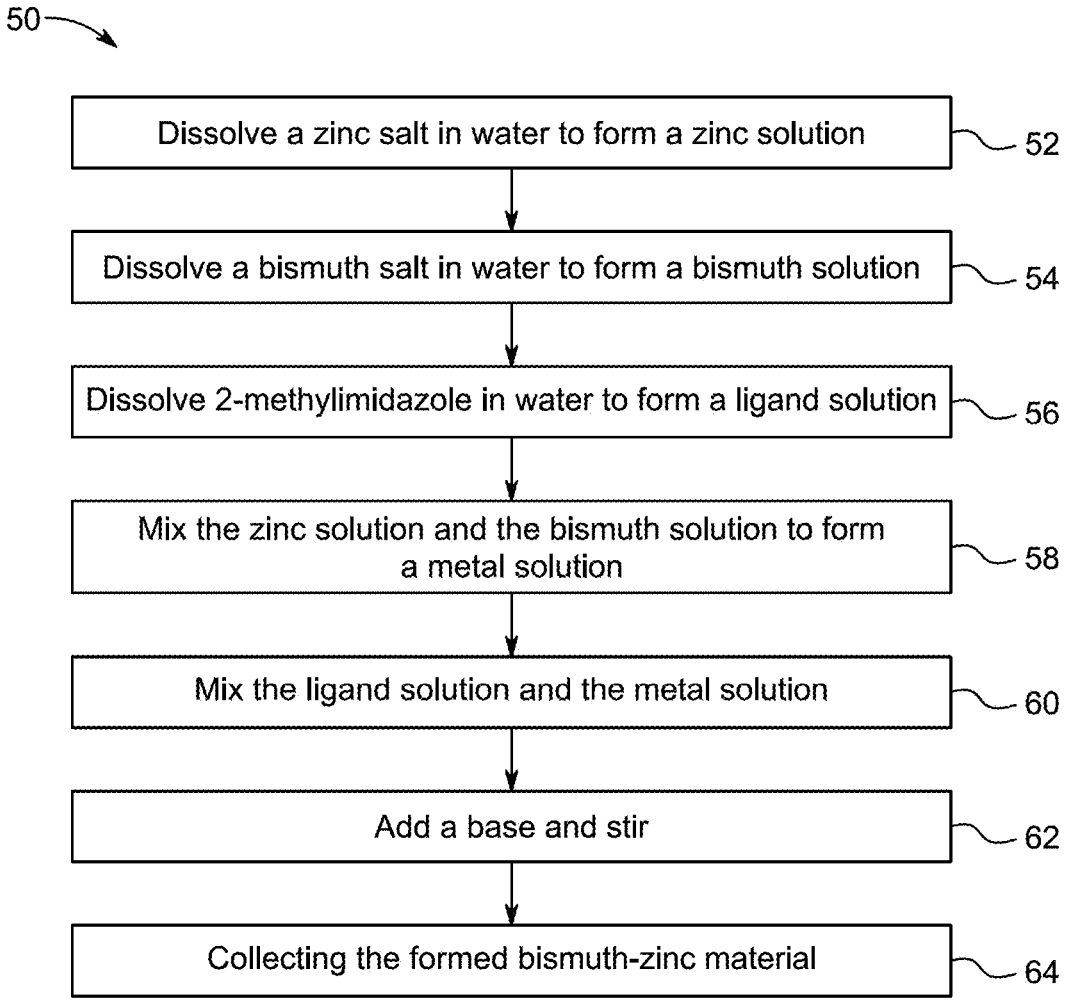
FIG. 1A is a schematic flow chart of a method of making a bismuth-zinc material, according to certain embodiments.

In the following description, it is understood that other embodiments may be utilized, and structural and operational changes may be made without departure from the scope of the present embodiments disclosed herein.

When describing the present disclosure, the terms used are to be construed in accordance with the following definitions, unless a context dictates otherwise. Embodiments of the present disclosure will now be described more fully hereinafter with reference to the accompanying drawings wherever applicable, in which some, but not all embodiments of the disclosure are shown. In the drawings, like reference numerals designate identical or corresponding parts throughout the several views. Further, as used herein, the words "a," "an" and the like generally carry a meaning of "one or more," unless stated otherwise. Within the description of this disclosure, where a numerical limit or range is stated, the endpoints are included unless stated otherwise. Also, all values and subranges within a numerical limit or range are specifically included as if explicitly written out.

Furthermore, the terms "approximately," "approximate," "about," and similar terms generally refer to ranges that include the identified value within a margin of 20%, 10%, or preferably 5%, and any values therebetween.

Embodiments of the present disclosure will now be described more fully hereinafter with reference to the accompanying drawings, in which some, but not all embodiments of the disclosure are shown.

As used herein, the words "about," "approximately," or "substantially similar" may be used when describing magnitude and or position to indicate that the value and/or position described is within a reasonable expected range of values and/or positions. For example, a numeric value may have a value that is +/−0.1% of the stated value (or range of values), +/−1% of the slated value (or range of values), +/−2% of the stated value (or range of values), +/−5% of the slated value (or range of values), +/−10% of the staled value (or range of values), +/−15% of the stated value (or range of values), or +/−20% of the stated value (or range of values). Within the description of this disclosure, where a numerical limit or range is stated, the endpoints are included unless stated otherwise. Also, all values and subranges within a numerical limit or range are specifically included as if explicitly written out.

The present disclosure is intended to include all hydration states of a given compound or formula, unless otherwise noted or when heating a material.

In addition, the present disclosure is intended to include all isotopes of atoms occurring in the present compounds and complexes. Isotopes include those atoms having the same atomic number but different mass numbers. By way of general example, and without limitation, isotopes of hydrogen include deuterium and tritium.

As used herein, the term "electrolytic cell" refers to a device that facilitates a chemical reaction by applying an external electric current. The current drives a non-spontaneous reaction that would not occur spontaneously under standard conditions. The external energy source is a voltage applied between the cell's electrodes (preferably at least 2 electrodes), an anode and a cathode, which are immersed in an electrolyte solution.

As used herein, the term "water splitting" refers to the chemical reaction in which water is broken down into oxygen and hydrogen: $2\ H_2O \rightarrow 2\ H_2 + O_2$ As used herein, the term "current density" refers to the amount of electric current traveling per unit cross-section area.

As used herein, the term "Tafel slope" refers to the relationship between the overpotential and the logarithmic current density.

Aspects of the present disclosure are directed toward a method for immobilizing bismuth nanoparticles (BNP) onto ZIF-8 crystals. This method involves a technique that integrates BNP into the ZIF-8 framework, resulting in high-density and well-dispersed BNP within the ZIF-8 structure. The resulting BNP-doped ZIF-8 electrocatalysts (also referred to as a bismuth-zinc material) demonstrate an enhancement in formate production with selectivity up to 91% faradaic efficiency (FE). Additionally, an electrochemical $CO_2$ reduction system employing an all-solid-state electrolyte cell is utilized to achieve continuous production of formic acid with a high purity and concentration, approaching 100% by weight.

The bismuth-zinc material includes bismuth nanodots. In some embodiments, the nanodots may exist in various morphological shapes, such as, but not limited to, nanowires, nanocrystals, nanorectangles, nanotriangles, nanopentagons, nanohexagons, nanoprisms, nanodisks, nanocubes, nanoribbons, nanoblocks, nanobeads, nanotoroids, nanodiscs, nanobarrels, nanogranules, nanowhiskers, nanoflakes, nanofoils, nanopowders, nanoboxes, nanostars, tetrapods, nanobelts, nano-urchins, nanofloweres, mixtures thereof, and the like. The bismuth nanodots are dispersed on the zeolitic imidazolate framework 8. The bismuth-zinc material includes a zeolitic imidazolate framework-8 (ZIF-8).

As used herein, the term "zeolitic material" refers to a material having the crystalline structure or three-dimensional framework of, but not necessarily the elemental composition of, a zeolite. Zeolites are porous silicate or aluminosilicate minerals that occur in nature. Elementary building units of zeolites are $SiO_4$ (and, if appropriate, $AlO_4$) tetrahedra. Adjacent tetrahedra are linked at their corners via a common oxygen atom, which results in an inorganic macromolecule with a three-dimensional framework (frequently referred to as the zeolite framework). The three-dimensional framework of a zeolite also includes channels, channel intersections, and/or cages having dimensions in the range of 0.1-10 nanometers (nm), preferably 0.2-5 nm, and more preferably 0.2-2 nm. Water molecules may be present inside these channels, channel intersections, and/or cages. Zeolites which are devoid of aluminum may be referred to as "all-silica zeolites" or "aluminum-free zeolites." Some zeolites which are substantially free of, but not devoid of, aluminum are referred to as "high-silica zeolites." Sometimes, the term "zeolite" is used to refer exclusively to aluminosilicate materials, excluding aluminum-free zeolites or all-silica zeolites.

In some embodiments, the zeolitic material has a three-dimensional framework that is at least one zeolite framework selected from the group consisting of a 4-membered ring zeolite framework, a 6-membered ring zeolite framework, a 10-membered ring zeolite framework, and a 12-membered ring zeolite framework. The zeolite may have a natrolite framework (e.g., gonnardite, natrolite, mesolite, paranatrolite, scolecite, and tetranatrolite), edingtonite framework (e.g., edingtonite and kalborsite), thomsonite framework, analcime framework (e.g., analcime, leucite, pollucite, and wairakite), phillipsite framework (e.g., harmotome), gismondine framework (e.g., amicite, gismondine, garronite, and gobbinsite), chabazite framework (e.g., chabazite-series, herschelite, willhendersonite, and SSZ-13), faujasite framework (e.g., faujasite-series, Linde type X, and Linde type Y), mordenite framework (e.g., maricopaite and mordenite), heulandite framework (e.g., clinoptilolite and heulandite-series), stilbite framework (e.g., barrerite, stellerite, and stilbite-series), brewsterite framework, cowlesite framework, and the like. In some embodiments, the porous silicate and/or aluminosilicate matrix is a zeolitic material having a zeolite framework selected from a group comprising of ZSM-5, ZSM-8, ZSM-11, ZSM-12, ZSM-18, ZSM-23, ZSM-35, and ZSM-39. In a preferred embodiment, the zeolitic material is a ZIF-8.

The bismuth-zinc material is in the form of particles with the longest dimension of 200 to 1000 nm, preferably 400 to 900 nm, preferably 400 to 600 nm, more preferably 450 to 550 nm, and yet more preferably about 500 nm. Bismuth is present in an amount of 7 to 8 percent by weight (wt. %), preferably 7.1 to 7.9 wt. %, preferably 7.2 to 7.8 wt. %, preferably 7.3 to 7.7 wt. %, more preferably 7.4 to 7.6 wt. %, and yet more preferably about 7.5 wt. %, based on the total weight of the bismuth-zinc material. In some embodiments, bismuth nanoparticles are introduced into the ZIF-8 framework to complete the doping process in less than 10 minutes. Zinc is present in an amount of 9 to 10 percent by weight (wt. %), preferably 9.1 to 9.9 wt. %, preferably 9.2 to 9.8 wt. %, preferably 9.4 to 9.75 wt. %, more preferably 9.5 to 9.7 wt. %, and yet more preferably about 9.6 wt. %, based on the total weight of the bismuth-zinc material.

FIG. 1A illustrates a schematic flow chart of a method 50 of making the bismuth-zinc material. The order in which the method 50 is described is not intended to be construed as a limitation, and any number of the described method steps can be combined in any order to implement the method 50. Additionally, individual steps may be removed or skipped from the method 50 without departing from the spirit and scope of the present disclosure.

At step 52, the method 50 includes dissolving a zinc salt in water to form a zinc solution. In some embodiments, the zinc salt may include, but is not limited to, zinc sulfate, zinc chloride, zinc nitrate, zinc acetate, zinc carbonate, zinc oxide, zinc phosphate, combinations thereof, and the like. In a preferred embodiment, the zinc salt is a zinc nitrate, more preferably zinc nitrate hexahydrate. In some embodiments, the concentration of the zinc salt is in the range of 10-50 mM, preferably 15-45 mM, preferably 20-40 mM, preferably 25-35 mM, preferably 30-35 mM, and preferably about 35 mM. The water may be tap water, distilled water, bi-distilled water, deionized (DI) water, deionized distilled water, reverse osmosis water, hard water, fresh water, brine/salt water, hard water, and fresh water. In a preferred embodiment, water is deionized (DI) water.

At step 54, the method 50 includes dissolving a bismuth salt in water to form a bismuth solution. In some embodiments, the bismuth salt may include, but is not limited to, bismuth subsalicylate, bismuth nitrate, bismuth chloride, bismuth oxide, bismuth citrate, combinations thereof, and the like. In a preferred embodiment, the bismuth salt is a bismuth nitrate, preferably bismuth nitrate pentahydrate. In some embodiments, the concentration of the bismuth salt is in the range of 1-20 mM, preferably 2-19 mM, preferably 3-18 mM, preferably 4-17 mM, preferably 5-16 mM, preferably 6-15 mM, preferably 7-14 mM, preferably 8-12 mM, more preferably 9-10 mM, and yet more preferably about 9.6 mM. In a preferred embodiment, the concertation of the bismuth salt is about 9.5-10 mM. In some embodiments, the water may be tap water, distilled water, bi-distilled water, deionized (DI) water, deionized distilled water, reverse osmosis water, hard water, fresh water, brine/salt water, the hard water, and freshwater. In a preferred embodiment, water is deionized (DI) water.

At step 56, the method 50 includes dissolving 2-methylimidazole in water to form a ligand solution. Optionally, other imidazoles such as nitroimidazole, benzimidazole, 4-methylimidazole, 4-nitro imidazole, N-propyl imidazole, and the like may be used in place of or in combination with the 2-methylimidazole. The ligand solution may optionally include a surfactant. Examples of surfactants include cetyltrimethylammonium bromide, hexadecyltrimethylammonium chloride, kayexalate, lauryl sodium sulfate, neopelex, and the like.

At step 58, the method 50 includes mixing the zinc solution and the bismuth solution to form a metal solution. In some embodiments, mixing the zinc solution and the bismuth solution to form a metal solution can be done for 2-8 minutes, preferably 3-7 minutes, more preferably 4-6 minutes, and yet more preferably about 5 minutes. In some embodiments, the mixing may be done by stirring, swirling, sonicating, a combination thereof, and any methods known in the art may be employed to form the metal solution.

At step 60, the method 50 includes mixing the ligand solution and the metal solution. In some embodiments, mixing the ligand solution and the metal solution can be done for 2-8 minutes, preferably 3-7 minutes, more preferably 3-6 minutes, and yet more preferably about 5 minutes. In some embodiments, the mixing can be done by stirring, swirling, sonicating, a combination thereof, and any methods known in the art may be employed to mix the ligand solution and the metal solution.

At step 62, the method 50 includes adding a base and stirring to form the bismuth-zinc material. The base may include, but is not limited to, potassium borohydride, sodium borohydride, lithium borohydride, sodium hydride, calcium hydride, magnesium hydride, sodium hydroxide, potassium hydroxide, combinations thereof, and the like. In a preferred embodiment, the base is sodium borohydride ($NaBH_4$). In some embodiments, the base is mixed with water before being added to the ligand solution and the metal solution. In some embodiments, the stirring can be done for 2-8 minutes, preferably 3-7 minutes, more preferably 4-6 minutes, and yet more preferably about 5 minutes. In some embodiments, the mixing can be done by stirring, swirling, sonicating, or a combination thereof.

At step 64, method 50 includes collecting the formed bismuth-zinc material. In some embodiments, the formed bismuth-zinc material is collected by centrifugation, but other methods of filtration may be used. The bismuth-zinc material may be further washed to remove any impurities or unreacted reactants/salts and dried for use.

Figure 1B:
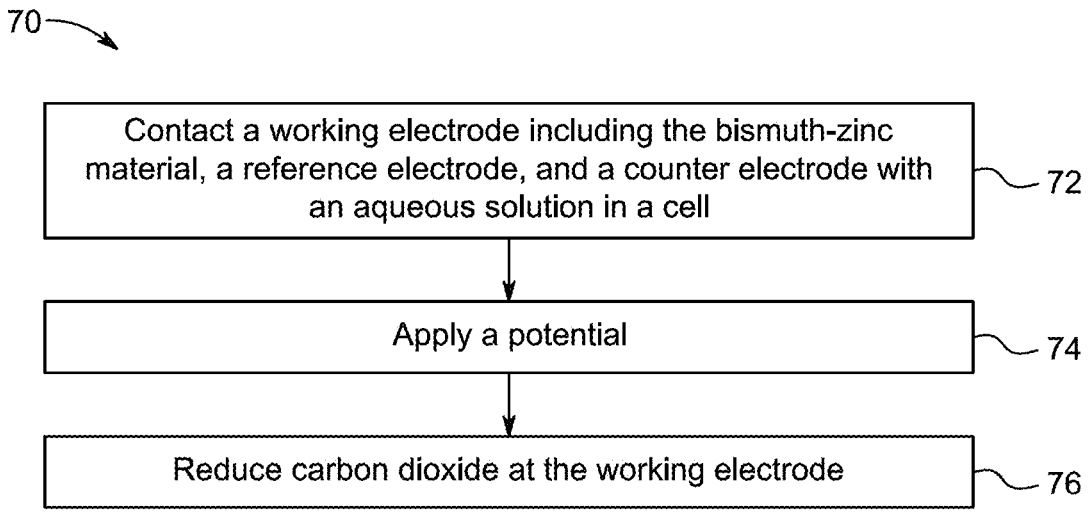
FIG. 1B is a schematic flow chart of a method of carbon dioxide reduction, according to certain embodiments.

FIG. 1B illustrates a schematic flow chart of a method 70 of carbon dioxide reduction. The order in which the method 70 is described is not intended to be construed as a limitation, and any number of the described method steps can be combined in any order to implement the method 70. Additionally, individual steps may be removed or skipped from the method 70 without departing from the spirit and scope of the present disclosure.

At step 72, the method 70 includes contacting a working electrode including the bismuth-zinc material, a reference electrode, and a counter electrode with an aqueous solution in a cell. The working electrode refers to an electrode in an electrochemical cell/device/sensor on which the electrochemical reaction of interest is occurring. The working electrode further includes a carbon paper and a sulfonated tetrafluoroethylene-based fluoropolymer-copolymer. Optionally, polyphenylsulfone (PPSU), sulfated poly(tetrafluoroethylene-co-perfluoromethylvinyl ether) (PFA), Flemion®, Aciplex®, Solef® 6000, combinations thereof, and the like may be used in combination with or instead of sulfonated tetrafluoroethylene-based fluoropolymer-copolymer.

As used herein, the term "reference electrode" refers to an electrode with a stable and well-known electrode potential. In some embodiments, the reference electrode is a silver/silver chloride (Ag/AgCl) electrode. In some embodiments, the reference electrode may be a standard hydrogen electrode (SHE), a calomel electrode (saturated calomel electrode, SCE), a copper/copper sulfate electrode ($Cu/CuSO_4$), a standard calomel electrode (SCE), a Luggin capillary electrode, a mercury/mercury oxide (Hg/HgO) electrode, and any other reference electrodes known in the art. As used herein, the term "counter electrode" or "auxiliary electrode" refers to an electrode used in an electrochemical cell for voltametric analysis and/or other reactions in which an electric current is expected to flow. An outer surface of the counter electrode may include an inert, electrically conducting chemical substance, such as platinum, gold, or carbon. The carbon may be in the form of graphite or glassy carbon. In an embodiment, the counter electrode is a platinum mesh. In one embodiment, the counter electrode may be a wire, a rod, a cylinder, a tube, a scroll, a sheet, a piece of foil, a woven mesh, a perforated sheet, a brush, and the like. The counter electrode material should thus be sufficiently inert to withstand the chemical conditions in the electrolyte solution, such as acidic or basic pH values, without substantially degrading during the electrochemical reaction. In addition, the counter electrode should preferably not leach out any chemical substance that interferes with the electrochemical reaction or might lead to undesirable electrode contamination.

In some embodiments, the reference electrode and the counter electrode may be connected through electrical interconnects that allow for the passage of current between the electrodes when a potential is applied. In an embodiment, the reference electrode and the counter electrode can have the same or different dimensions. The reference electrode and the counter electrode may be arranged as obvious to a person of ordinary skill in the art.

In some embodiments, the aqueous solution may be an aqueous basic solution. The aqueous basic solution may include water and an inorganic base. The base may be selected from a group consisting of an alkaline earth metal hydroxide, such as beryllium hydroxide ($Be(OH)_2$), magnesium hydroxide ($Mg(OH)_2$), strontium hydroxide ($Sr(OH)_2$), and calcium hydroxide ($Ca(OH)_2$), and/or an alkali metal hydroxide, such as lithium hydroxide (LiOH), sodium hydroxide (NaOH), potassium hydroxide (KOH), rubidium hydroxide (RbOH), and cesium hydroxide (CsOH). In some embodiments, the aqueous solution includes an ionic salt as an electrolyte. In a preferred embodiment, the ionic salt is potassium bicarbonate. In a preferred embodiment, the aqueous solution includes potassium hydroxide.

In some embodiments, the cell is an H-type cell. An H-type cell is a double compartment electrochemical device with a two cell halves (H-cell) separated by a porous glass frit. In some embodiments, the cell is membrane electrode assembly (MEA) cell. An MEA cell is an electrochemical device with a central electrolyte membrane and electrodes coated with catalysts, used in fuel cells, electrolyzers, and other electrochemical systems to enable efficient and controlled reactions. In some embodiments, the cell is a flow cell. A flow cell is an electrochemical cell designed to facilitate continuous fluid flow through the cell's reaction chambers. In other embodiments, the cell may be any cell known in the art that is conducive for electrochemical reactions.

At step 74, the method 70 includes applying a potential.

At step 76, the method 70 includes reducing carbon dioxide at the working electrode.

In some embodiments, the cell is an H-type cell, and the working electrode has a Faradaic efficiency of 50 to 70%, preferably 52 to 68%, more preferably 55 to 65%, and yet more preferably about 60% for formic acid conversion from carbon dioxide based on an initial amount of carbon dioxide at a potential of −1.3 V vs. RHE and a current density of 40 to 60 $mA/cm^2$, preferably 43 to 57 $mA/cm^2$, preferably 45 to 55 $mA/cm^2$, more preferably 48 to 52 $mA/cm^2$, and yet more preferably about 50 $mA/cm^2$. In some embodiments, the cell is an H-type cell, and the working electrode has a Faradaic efficiency of 40 to 50%, preferably 42 to 48%, more preferably 44 to 46%, and yet more preferably about 45% for formic acid conversion from carbon dioxide based on an initial amount of carbon dioxide at a potential of −1.5 V vs. RHE.

In some embodiments, the cell is an H-type cell, and the working electrode has a Faradaic efficiency of 40 to 60%, preferably 45 to 55%, more preferably 47 to 53%, and yet more preferably about 50% for carbon monoxide conversion from carbon dioxide based on an initial amount of carbon dioxide at a potential of −0.7 V vs. RHE.

In some embodiments, the cell is a flow cell, and the working electrode has a Faradaic efficiency of 75 to 85%, preferably 76 to 84%, preferably 77 to 83%, preferably 78 to 82%, more preferably 79 to 81%, and yet more preferably about 80% for formic acid conversion from carbon dioxide based on an initial amount of carbon dioxide at a potential of −1.1 V vs. RHE and a current density of 110 to 130 mA/cm$^2$, preferably 113 to 127 mA/cm$^2$, preferably 115 to 125 mA/cm$^2$, more preferably 118 to 122 mA/cm$^2$, and yet more preferably about 120 mA/cm$^2$.

In some embodiments, the cell is a MEA cell, and the working electrode has a Faradaic efficiency of 85 to 95%, preferably 86 to 94%, more preferably 88 to 92%, and yet more preferably about 91% for formic acid conversion from carbon dioxide based on an initial amount of carbon dioxide at a potential of −1.1 V vs. RHE and a current density of 140 to 160 mA/cm$^2$, preferably 143 to 157 mA/cm$^2$, preferably 145 to 155 mA/cm$^2$, more preferably 148 to 152 mA/cm$^2$, and yet more preferably about 150 mA/cm$^2$ for 3 to 5 hours, preferably 3.2 to 4.8 hours, preferably 3.5 to 4.5 hours, more preferably 3.8 to 4.2 hours, and yet more preferably about 4 hours.

In some embodiments, the working electrode has a charge transfer resistance of 5 to 15 Ω/cm$^2$, preferably 7 to 13 Ω/cm$^2$, more preferably 9 to 11 Ω/cm$^2$, and yet more preferably about 10 Ω/cm$^2$. Charge transfer resistance refers to the resistance encountered by the flow of electric charge as it moves across the interface between an electrode and an electrolyte during an electrochemical reaction. This resistance indicates the ease or difficulty in transferring electrons between the electrode and the reactants or products in the solution. In some embodiments, the working electrode has a double layer capacitance of 5 to 15 mF/cm$^2$, preferably 7 to 13 mF/cm$^2$, more preferably 9 to 11 mF/cm$^2$, and yet more preferably about 10 mF/cm$^2$.

One parameter used to evaluate the kinetics of the reaction is the Tafel slope. The slope of a Tafel curve represents a Tafel slope, which is related to the activation energy of the reaction. Therefore, the slope indicates the reaction rate. The steeper the slope, the higher the activation energy for the reaction to occur and the slower the reaction rate. In some embodiments, the cell is a flow cell, and the working electrode has a Tafel slope of 30 to 50 mV/dec, preferably 35 to 47 mV/dec, preferably 38 to 45 mV/dec, more preferably 41 to 43 mV/dec, and yet more preferably about 42 mV/dec.

In some embodiments, the cell is an H-type cell, and the working electrode has a current density of −70 to −50 mA/cm$^2$, preferably −68 to −52 mA/cm$^2$, more preferably −65 to −55 mA/cm$^2$, and yet more preferably about −60 mA/cm$^2$ at a potential of −1.5 V vs. RHE. Bi-ZIF-8 showed much higher conductivity than ZIF-8. Bi-ZIF-8 also showed a higher electrochemical active surface area than ZIF-8. Bi-ZIF-8 demonstrated a 60% FE for formic acid conversion at −1.3 V vs. RHE and a current density of −40 mA cm$^{-2}$. In some embodiments, the cell is a flow cell, and the working electrode has a current density of −260 to −240 mA/cm$^2$, preferably −257 to −243 mA/cm$^2$, more preferably −255 to −245 mA/cm$^2$, and yet more preferably about −250 mA/cm$^2$ at a potential of −1.5 V vs. RHE. In some embodiments, the cell is a flow cell, and the working electrode is stable for 8 to 18 hours, preferably 9 to 16 hours, more preferably 10 to 12 hours, and yet more preferably about 11 hours at a current density of −120 mA/cm$^2$. Bi-ZIF-8 demonstrated about an 80% FE for the formic acid conversion at −1.1 V vs. RHE and a current density of −140 mA cm$^{-2}$. Bi-ZIF-8 showed a partial current density of −120 mA cm$^{-2}$ for the formic acid conversion at a potential of −1.1 V vs. RHE. In some embodiments, the cell is an MEA cell, and a current density of 20 to 200 mA/cm$^2$ was used in electrocatalysis. In some embodiments, the cell is an MEA cell, and a Faradic efficiency of 91% for formic acid conversion at a full cell voltage of 3.25 V vs RHE and a current density of 150 mA/cm$^2$ was achieved. In some embodiments, the cell is an MEA cell, and the working electrode is stable for 3 to 5 hours, preferably 3.5 to 4.5 hours, and more preferably about 4 hours at a current density of 150 mA/cm$^2$.

Figure 1C:
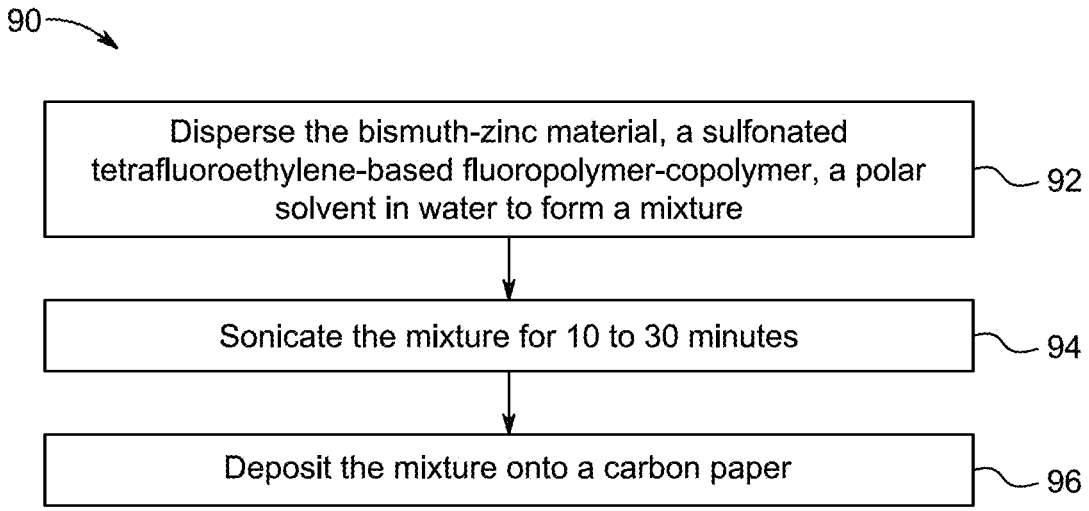
FIG. 1C is a schematic flow chart of a method of making a working electrode, according to certain embodiments.

FIG. 1C illustrates a schematic flow chart of a method 90 of making the working electrode. The order in which the method 90 is described is not intended to be construed as a limitation, and any number of the described method steps can be combined in any order to implement the method 90. Additionally, individual steps may be removed or skipped from the method 90 without departing from the spirit and scope of the present disclosure.

At step 92, the method 90 includes dispersing the bismuth-zinc material, a sulfonated tetrafluoroethylene-based fluoropolymer-copolymer, a polar solvent in water to form a mixture. The polar solvent may include, but is not limited to, water, methanol, ethanol, isopropanol acetone, dimethyl sulfoxide (DMSO), hydrochloric acid, ammonia. In a preferred embodiment, the polar solvent is isopropanol.

At step 94, the method 90 includes sonicating the mixture for 10 to 30 minutes, preferably 15 to 28 minutes, more preferably 20 to 28 minutes, and yet more preferably about 25 minutes. The sonication is carried out to form the mixture. In some embodiments, other modes of agitation known to those of ordinary skill in the art, for example, via stirring, swirling, mixing, or a combination thereof, may be employed in place of or in combination with sonicating to form the mixture.

At step 96, the method 90 includes depositing the mixture onto the carbon paper. In some embodiments, the mixture may be dispersed on the carbon paper using a technique such as physical vapor deposition (PVD), chemical vapor deposition (CVD), spin coating, dip coating, electrophoretic deposition (EPD), langmuir-blodgett (LB) technique, drop-casting, sol-gel process, layer-by-layer (LbL) assembly, ink-jet printing, spray coating, ultrasonic spray deposition, and any method known in the art. In a preferred embodiment, the mixture may be dispersed on the carbon paper using a drop-casting method.

EXAMPLES

The following examples describe and demonstrate bismuth nanoparticles doped in zinc material and use of the material as an electrocatalyst. The examples are provided solely for illustration and are not to be construed as limitations of the present disclosure, as many variations are possible without departing from the spirit and scope of the present disclosure.

Example 1: Materials

Analytical grade bismuth nitrate pentahydrate (99%) ($Bi(NO_3)_3 \cdot 5H_2O$), zinc nitrate hexahydrate ($Zn(NO_3)_2 \cdot 6H_2O$), sodium borohydride ($NaBH_4$), and 2-methylimidazole (MeIm) were purchased from Sigma-Aldrich. All of the chemicals were analytical grade and were used without additional purification. An MEA cell was purchased from Dioxide Materials and Membranes International, Inc., and a Nafion membrane was purchased from Fuel Cell Store.

Example 2: BiND-ZIF-8 Synthesis $Zn(NO_3)_2 \cdot 6H_2O$ (100 mg) was dissolved in 15 mL of DI water. In another beaker, 70 mg of $Bi(NO_3)_3 \cdot 5H_2O$ was dissolved in 15 mL DI water. In a separate beaker, 15 mL of deionized (DI) water was mixed with 1.94 g of 2-methylimidazole. A clear solution of $Zn(NO_3)_2 \cdot 6H_2O$ was mixed with $Bi(NO_3)_3 \cdot 5H_2O$ (70 mg) and dissolved. 2-methylimidazole was added to the Zn and Bi solution, and the mixture was stirred for 5 minutes. Then, a freshly prepared solution of 50 mg $NaBH_4$ in 2 mL DI water was quickly added to the mixture and stirred for 5 minutes. Following the reaction, the products were centrifuged, washed three times with deionized water, and vacuum-dried before characterization and activity analysis.

Example 3: Electrode Preparation for H Cell

The BiND-ZIF-8 catalyst (10 mg) was distributed in a solution containing 750 microliters (μL) of isopropanol, 200 μL of deionized water, and 50 μL of Nafion (5%). The overall volume amounted to 1 mL. The solution underwent sonication for 25 minutes. Subsequently, a 100 μL solution was administered onto a conductive carbon paper with a 1 $cm^2$ surface area using the drop-casting technique. Subsequently, the sample was permitted to desiccate at ambient temperature.

Example 4: Electrode Preparation for Flow Cell

The above-mentioned ink for the H Cell was painted on GDE (0.5×2 $cm^2$ area) using a spray gun with a constant nitrogen pressure. The conductive surface of a gas diffusion electrode (GDE) was loaded with catalyst and dried in air, followed by vacuum drying at 50° C.

Example 5: Electrode Preparation for MEA Cell

A Sigracet 38 BC gas diffusion layer (GDL) with an area of 6.25 $cm^2$ (2.5 cm×2.5 cm) was utilized as the porous transport layer. A spray coating of BiND-ZIF-8 catalyst was applied onto the microporous layer of GDL followed by drying at 50° C.

Example 6: Electrode Preparation for Solid State Electrolyte Cell 5 mg of BiND-ZIF-8 loaded on a GDL electrode and a Pd/C electrode were employed as a cathode and anode, respectively. The ink was painted on GDE (2.5×2.5 $cm^2$ area) using a spray gun with a constant nitrogen pressure. The fabricated electrode was dried in air and then dried in a vacuum oven at 50° C.

Example 7: Activity Test in H Cell

The behavior of $CO_2RR$ was initially investigated using an H-cell device (FIG. 6A) that included a silver-silver chloride electrode (Ag/AgCl) as a reference electrode. A counter electrode made of platinum mesh was used. The working electrode was affixed onto a conductive carbon paper substrate. The electrodes within the cell were linked to a Gammray 620 type potentiostat. The performance of $CO_2RR$ was evaluated using linear sweep voltammetry (LSV) techniques, which involved measuring the current densities at different applied potentials, with the current values adjusted for the electrode's geometric surface area (1 $cm^2$).

Example 8: Activity Test in Flow Cell

A flow cell (FIG. 9A) was employed to validate the performances under elevated current densities. The performances of $CO_2RR$ were assessed across a range of potentials (−0.7 to −1.5 V vs. RHE) during hour long tests. Liquid products were obtained from the cell and measured using $^1$H-NMR. Gaseous products were examined using a gas chromatography-barrier discharge ionization detector (GC-BID). This detector offers a sensitivity that is two orders of magnitude greater than TCD detectors when it comes to gas phase components.

Example 9: Activity Test in MEA Cell

The MEA studies were conducted using a membrane electrode assembly (MEA) with a 5 $cm^2$ area. The MEA (Dioxide materials) included serpentine flow channels on both the anode and cathode endplates. The MEA was assembled by combining BiND-ZIF-8 coated on GDE and Ni foam (Recemat BV) with an enlarged area 16 $cm^2$ (4 cm×4 cm) Sustainion anion-exchange membrane (X37-50 Grade RT). The MEA was assembled by physically compressing the electrodes and endplates using a torque wrench with a tightening force of 4 Newton meter (Nm). A 1 M KOH solution was used as the anolyte, and humidified $CO_2$ was used as the reactant at the cathode. The reactor was supplied with this configuration at a flow rate of 50 standard cubic centimeters per minute (scc/min).

Figure 2A:
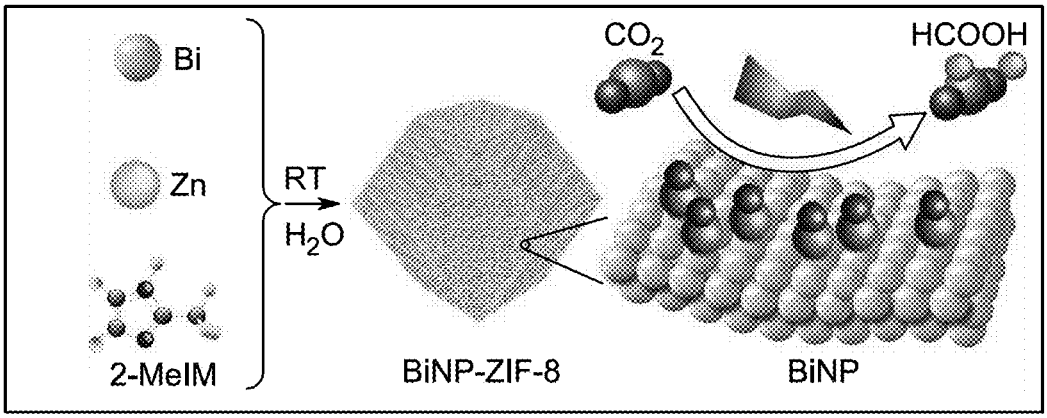
FIG. 2A depicts a synthetic scheme of a bismuth nanodot-decorated zeolitic imidazolate framework-8 (Bi-ZIF-8), according to certain embodiments.
Figure 2B:
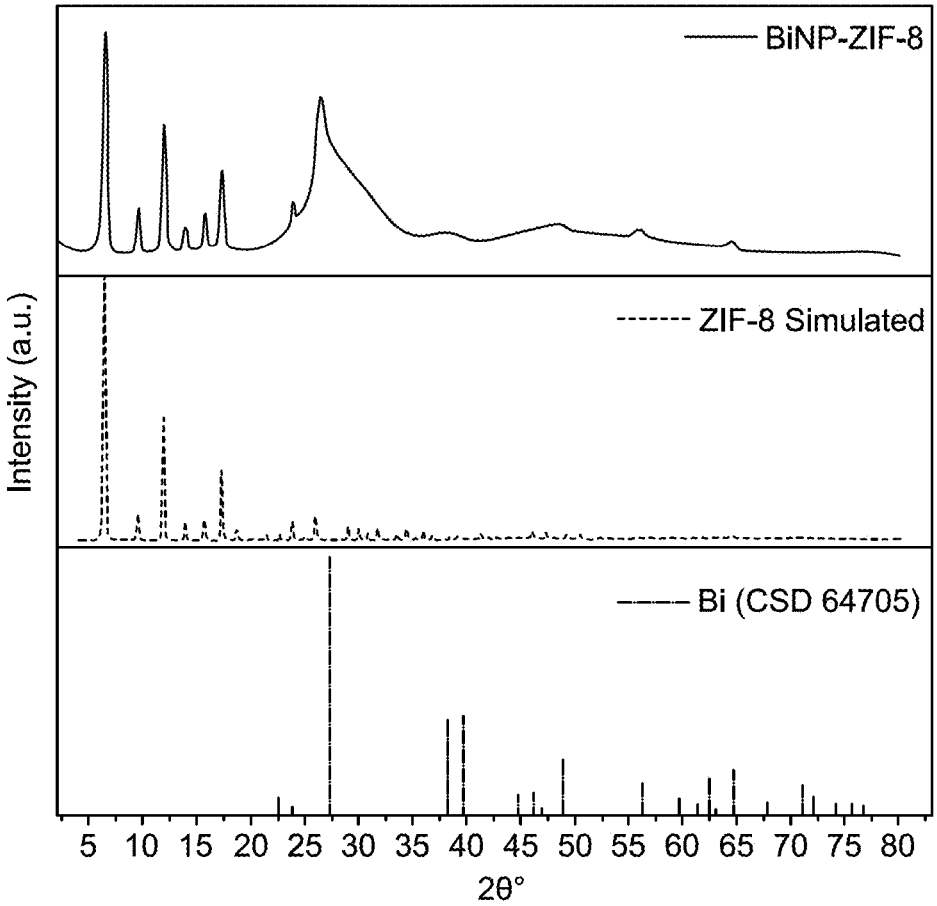
FIG. 2B depicts X-ray diffraction (XRD) reference patterns of bismuth (Bi) and ZIF-8 and the XRD pattern of Bi-ZIF-8, according to certain embodiments.

A sequence of continuous current electrolysis tests was conducted, and the gaseous substances produced by the cell were examined using an online gas chromatography system attached to the cell's outlet. The gas chromatography system had two thermal conductivity detectors and a flame ionization detector. An electrolysis process was conducted at various current densities ranging from 10 to 200 mA/$cm^2$. Each current density was maintained for 1200 seconds. Aliquots were collected at 5-minute intervals during the reaction, resulting in four injections for each current density over 1200 seconds. To determine faradic efficiency of the products, the flow rate at the reactor output was monitored using a Bronkhorst mass flow meter. ZIF-8 nanoparticles were decorated with bismuth nanodots (BND and/or BiND) that were made using a simple reduction technique. Large amounts of the products were synthesized without complex conditions during the whole synthesis process (FIG. 2A). In FIG. 2B, the XRD findings demonstrated that the synthesized Zn-2mIm had a comparable crystalline peak to the simulated XRD [Mahbub, M. A. A. et al., Dynamic Transformation of Functionalized Bismuth to Catalytically Active Surfaces for $CO_2$ Reduction to Formate at High Current Densities, *Adv Funct Mater,* 2024, 34, 2307752, which is incorporated herein by reference in its entirety]. Similarly, the BND exhibits XRD peaks consistent with the Bi standard atlas [Li, J. et al., N-doped carbon nanocage-anchored bismuth atoms for efficient $CO_2$ reduction, *Chemical Communications,* 2023, 59, 11991; and Li, J. et al., Rapid synthesis of a Bi@ZIF-8 composite nanomaterial as a near-infrared-II (NIR-II) photothermal therapy of hepatocellular carcinoma, *Nanoscale,* 2020, 12, 17064, which are incorporated herein by references in their entireties].

Figure 2C:
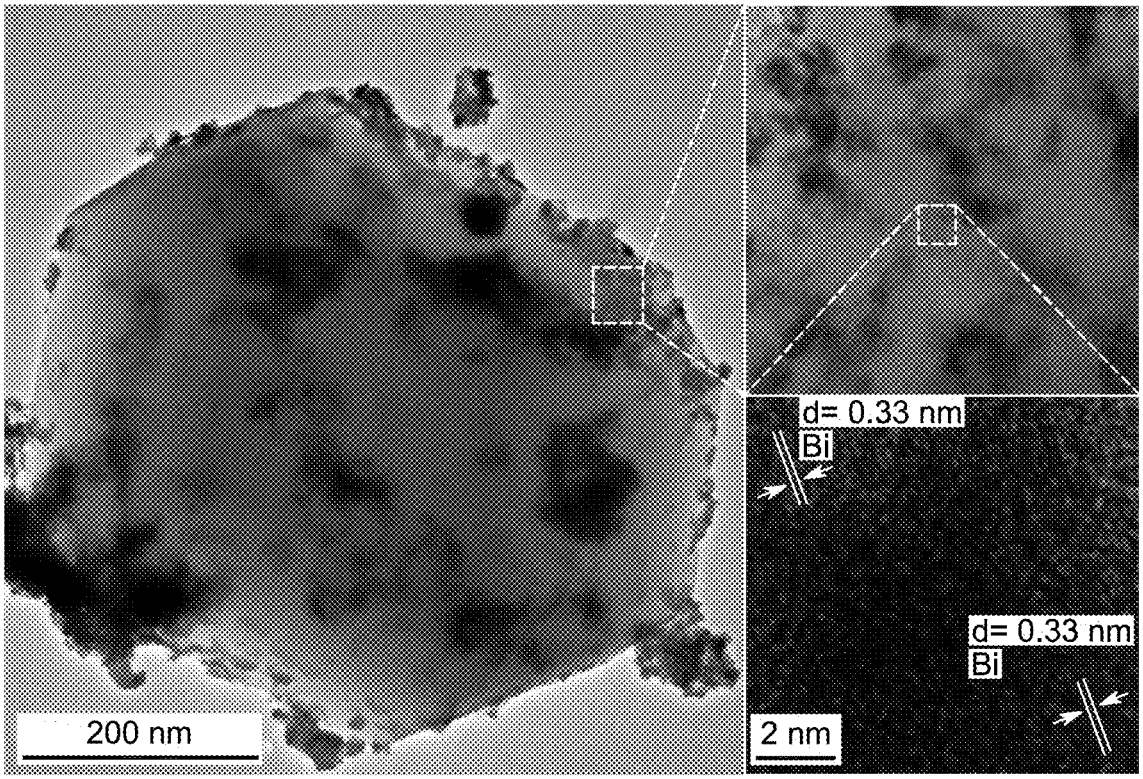
FIG. 2C depicts a transmission electron microscopy (TEM) image of Bi-ZIF-8, a high-resolution (HR) TEM image of Bi-ZIF-8 and d spacing of Bi nanodots, according to certain embodiments.
Figure 3A:
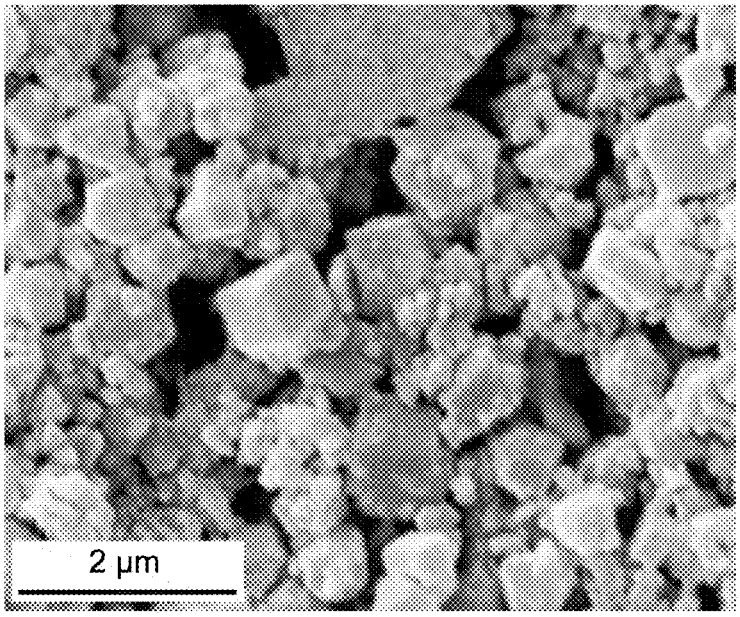
FIG. 3A depicts a scanning electron microscopy (SEM) image of Bi-ZIF-8, according to certain embodiments.
Figure 3B:
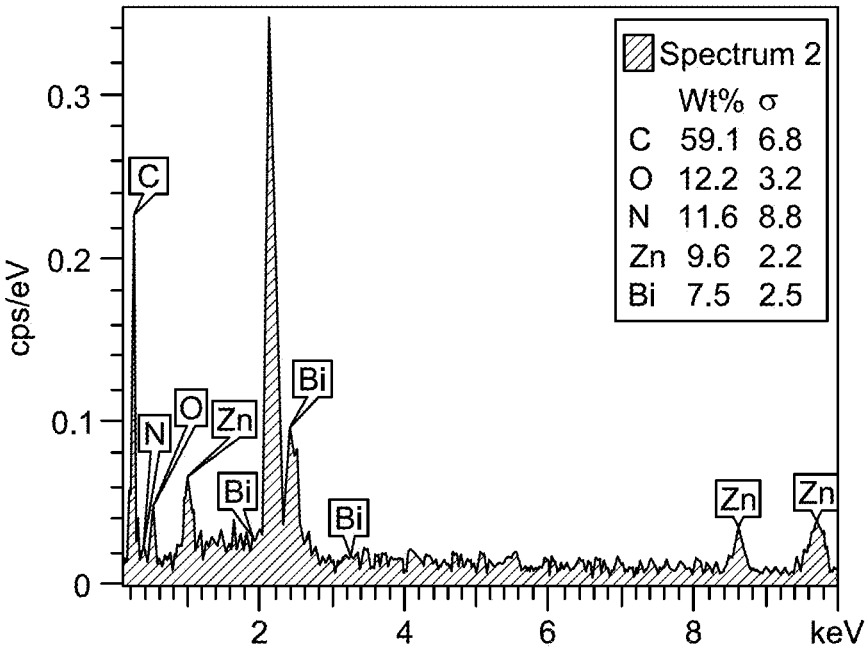
FIG. 3B shows a energy dispersive X-ray (EDX) spectrum of Bi-ZIF-8, according to certain embodiments.
Figure 3C:
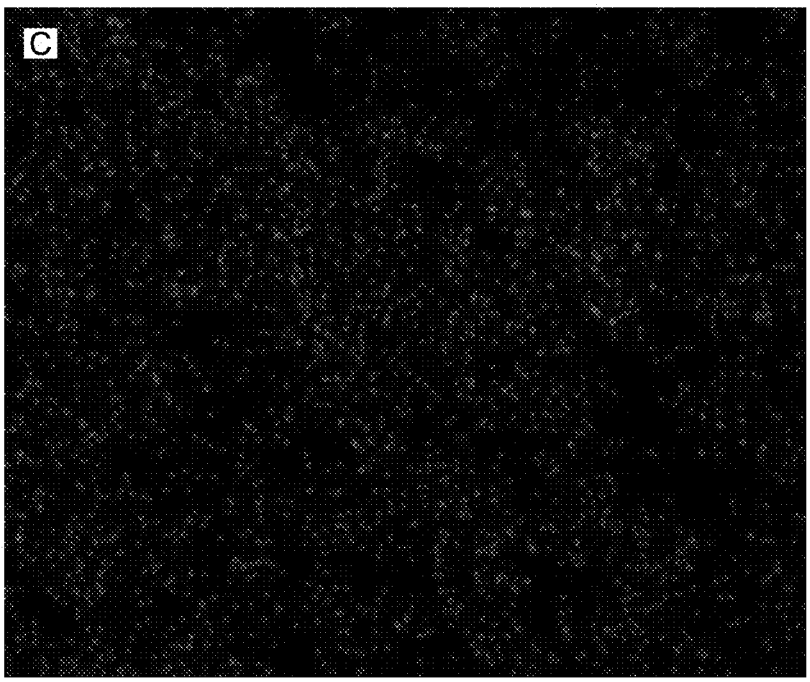
FIG. 3C depicts elemental mapping of carbon (C) in Bi-ZIF-8, according to certain embodiments.
Figure 3D:
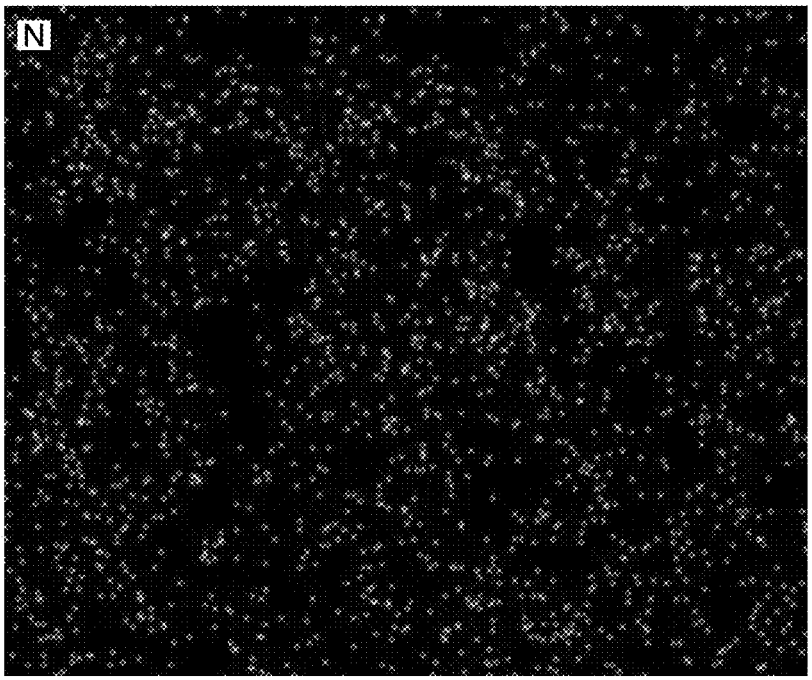
FIG. 3D depicts elemental mapping of nitrogen (N) in Bi-ZIF-8, according to certain embodiments.
Figure 3E:
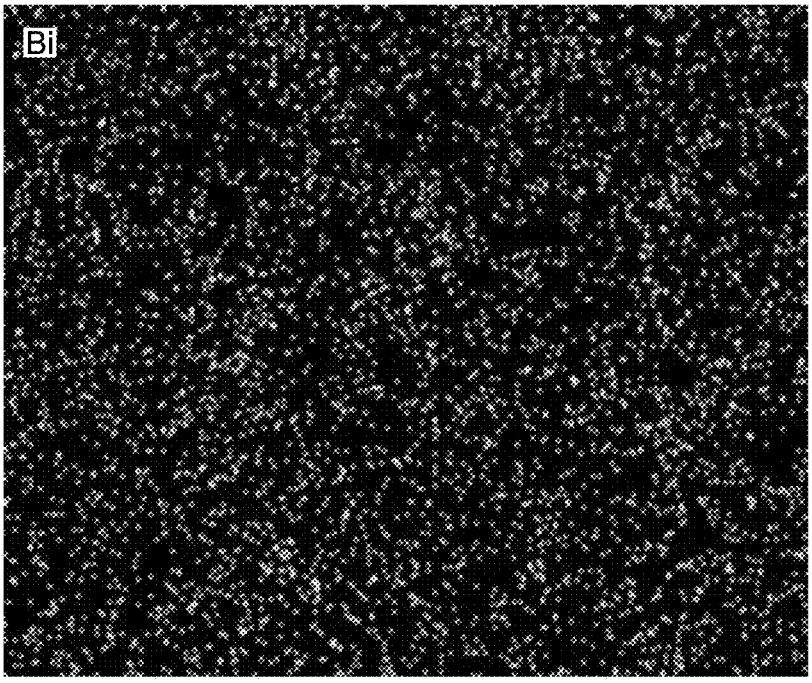
FIG. 3E depicts elemental mapping of bismuth (Bi) in Bi-ZIF-8, according to certain embodiments.
Figure 3F:
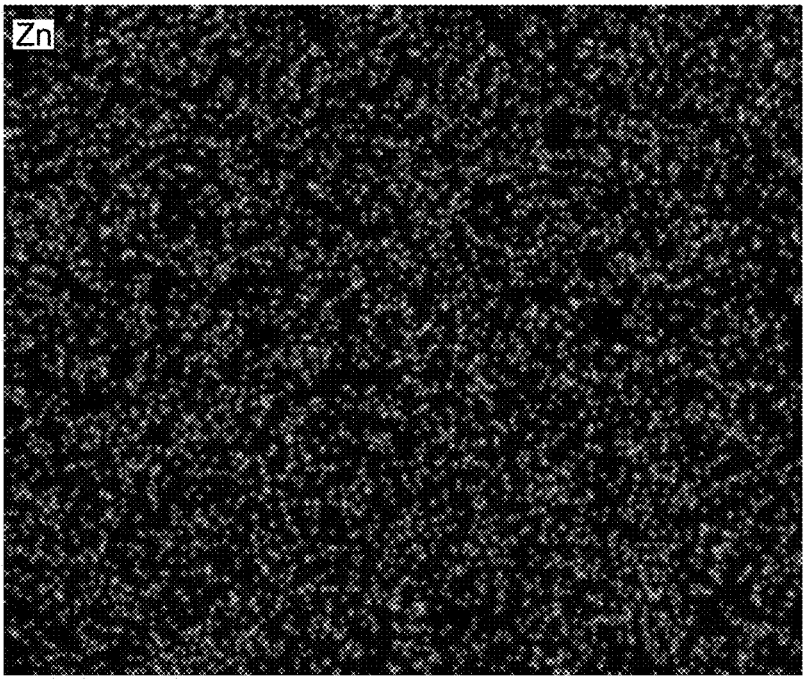
FIG. 3F depicts the elemental mapping of zinc (Zn) in Bi-ZIF-8, according to certain embodiments.

The compounds were characterized using transmission electron microscopy (TEM) (FIG. 2C). The findings show a particle size of ZIF-8 was around 500 nanometers (nm). The size of Zn-2mIm was attributed to the quick reaction time and high stirring speed. In addition, there were visible black nanodots in ZIF-8, indicating that the bismuth nanodots had been successfully fastened to ZIF-8, which was further supported by the high-resolution TEM (HR-TEM) through d-spacing, as shown in FIG. 2C, with an interplanar distance of 0.33 nm corresponding to the plane (012) of metallic Bi [Sepulveda-Guzman, S. et al., In situ formation of bismuth nanoparticles through electron-beam irradiation in a transmission electron microscope, *Nanotechnology,* 2007, 18, 335604; and Velisoju, V. K. et al, Copper Nanoparticles Encapsulated in Zeolitic Imidazolate Framework-8 as a Stable and Selective $CO_2$ Hydrogenation Catalyst, *Nat Commun,* 2024, 15, 2045, which are incorporated herein by references in their entireties]. Scanning electron microscopy (SEM) studies revealed that the nanoparticles were synthesized in substantial amounts (FIG. 3A), and the cubic crystal of ZIF-8 can be observed with no large agglomeration of Bi particles on the surface. The energy dispersive X-ray (EDX) in FIG. 3B confirms the presence of elements of Bi-ZIF-8, which are zinc (Zn), carbon (C), nitrogen (N), oxygen (O), and bismuth (Bi). Elemental mapping shows homogenous dispersion of C (FIG. 3C), N (FIG. 3D), Bi (FIG. 3E), and Zn (FIG. 3F) elements in the Bi-ZIF-8 sample.

Figure 4A:
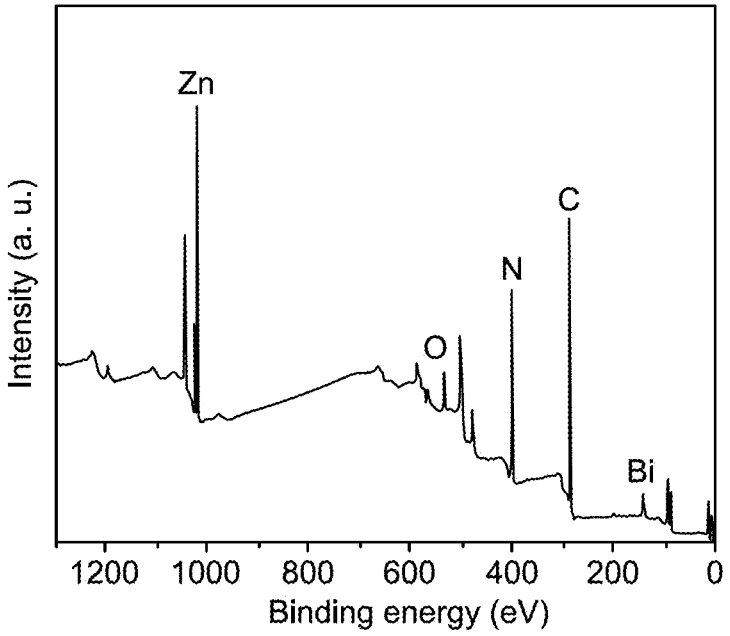
FIG. 4A shows an X-ray photoelectron spectroscopy (XPS) survey spectrum of Bi-ZIF-8, according to certain embodiments.
Figure 4B:
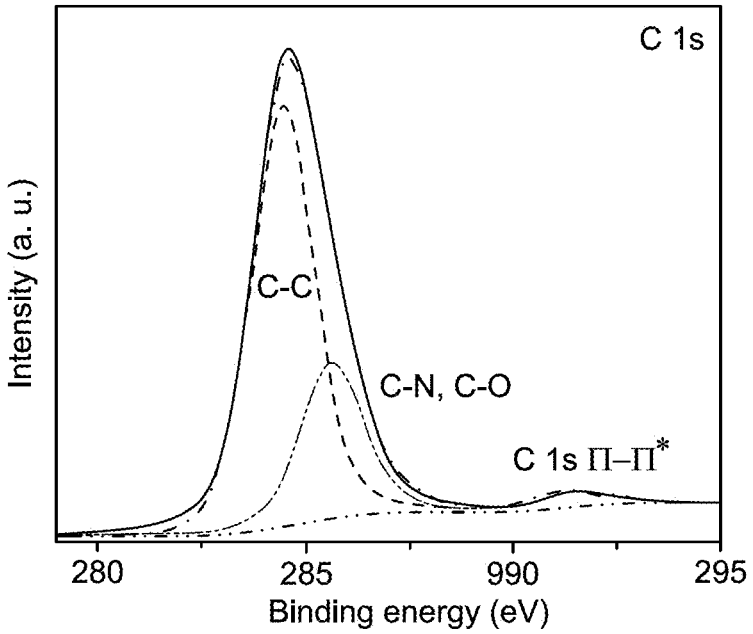
FIG. 4B shows a C is spectrum of Bi-ZIF-8, according to certain embodiments.
Figure 4C:
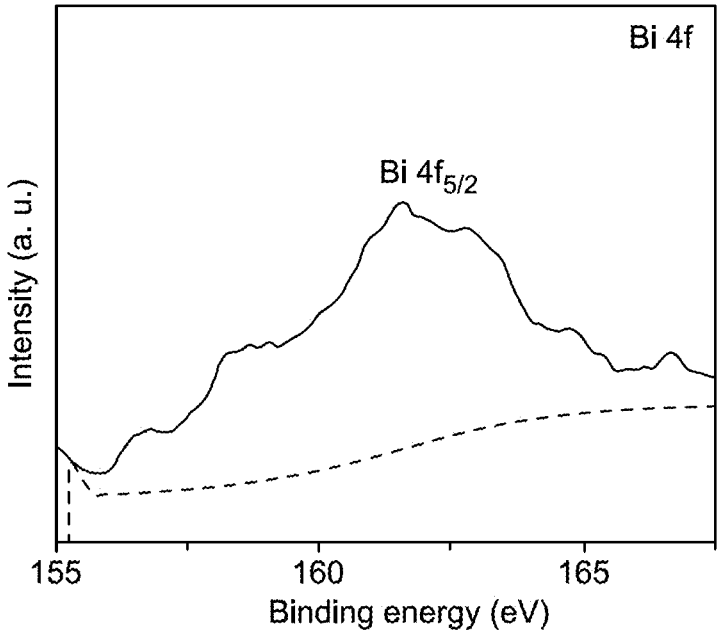
FIG. 4C shows a Bi 4f Spectrum of Bi-ZIF-8, according to certain embodiments.
Figure 4D:
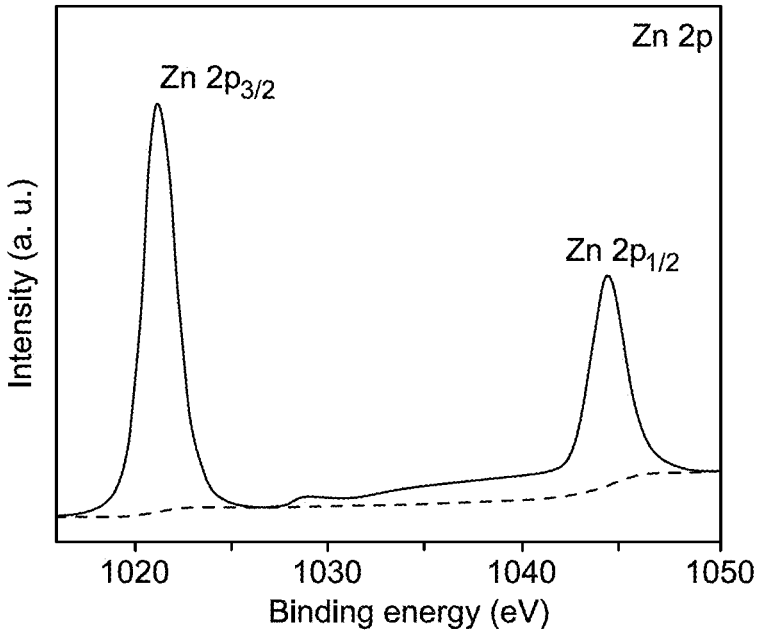
FIG. 4D shows a Zn 2p spectrum of Bi-ZIF-8, according to certain embodiments.

X-ray photoelectron spectroscopy (XPS) was utilized to investigate the chemical composition of the Bi-ZIF-8 sample. The survey spectrum (FIG. 4A) shows the existence of Zn, C, N, and O originating from the ZIF-8. A Bi peak was also observed in the XPS survey. The deconvoluted C 1s spectrum in FIG. 4B showed two peaks for C—C and (C═O, C═N) at binding energy of 283 and 286 eV, respectively The peak at a binding energy at 162 eV corresponds to the Bi metal, as seen in FIG. 4C [Zeng, Y. et al., In Situ Activation of 3D Porous Bi/Carbon Architectures: Toward High-Energy and Stable Nickel-Bismuth Batteries, *Advanced Materials,* 2018, 30, 1707290, which is incorporated herein by reference in its entirety]. The Zn spectrum in FIG. 4D shows two peaks at 1022 and 1045 eV binding energies for Zn $2p_{3/2}$ and Zn $2p_{1/2}$, respectively [Velisoju, V. K. et al., Copper Nanoparticles Encapsulated in Zeolitic Imidazolate Framework-8 as a Stable and Selective $CO_2$ Hydrogenation Catalyst, *Nat Commun,* 2024, 15, 2045, which is incorporated herein by reference in its entirety]. These spectra support the formation of Bi dispersed the framework of ZIF-8.

Figure 5:
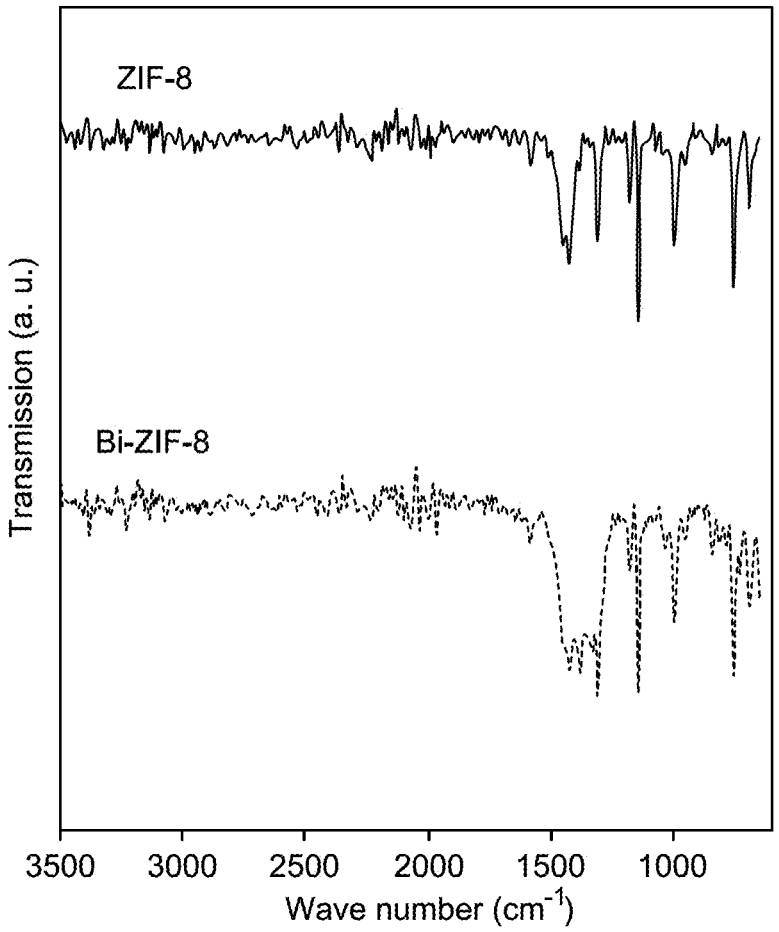
FIG. 5 depicts Fourier-transform infrared (FTIR) spectra of ZIF-8 and Bi-ZIF-8, according to certain embodiments.

FTIR analysis was conducted on ZIF-8 and Bi-ZIF-8, demonstrating similar IR spectra and is displayed in FIG. 5. The maximum point for 2-methylimidazole (MeIm) occurred at 690 $cm^{-1}$ due to the C—H bending vibration. The presence of the (═C—H) in-plane deformation vibration is indicated by the peak observed at 1150 $cm^{-1}$. The $CH_2$ wagging vibration occurs at 1307 $cm^{-1}$, while the ═C—H in-plane bending vibration occurs at 1002 $cm^{-1}$. $CH_3$ and $CH_2$ exhibit asymmetric bends at 1385 $cm^{-1}$ and 1430 $cm^{1}$, respectively. The C═C stretch has a peak at 1450 $cm^{-1}$ and the C═N stretch has a peak at 1583 $cm^{-1}$ [Nozari, V. et al., Ionic liquid facilitated melting of the metal-organic framework ZIF-8, *Nat Commun,* 2021, 12, 5703, which is incorporated herein by reference in its entirety]. The FTIR spectra of Bi-ZIF-8 supports that the framework remains intact even after loading with Bi.

Figure 6A:
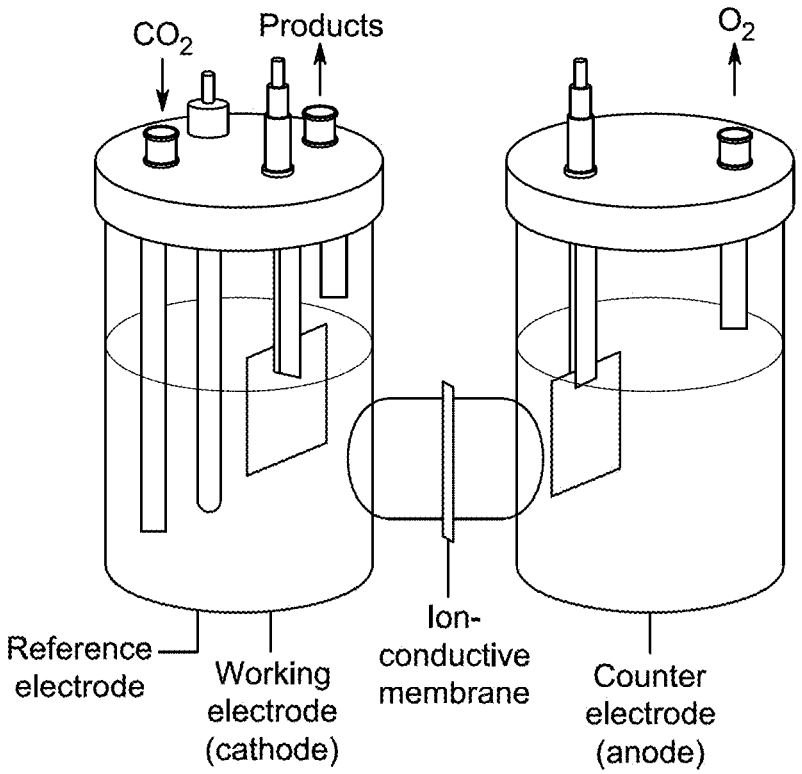
FIG. 6A shows a schematic configuration of an H-type cell, according to certain embodiments.

Cyclic voltammetry (CV) and linear sweep voltammetry (LSV) experiments were conducted using a 0.5 M potassium bicarbonate ($KHCO_3$) solution. The voltage span ranged from 0.0 to −1.5 V relative to the reference electrode, specifically the reversible hydrogen electrode (RHE) using an H-type cell, as shown in the scheme (FIG. 6A). Electrochemical impedance spectroscopy (EIS) was performed by varying the frequency range from $10^5$ to 0.1 Hz while keeping the electrolyte and electrode conditions constant, as in the linear sweep voltammetry (LSV) experiment.

Figure 6B:
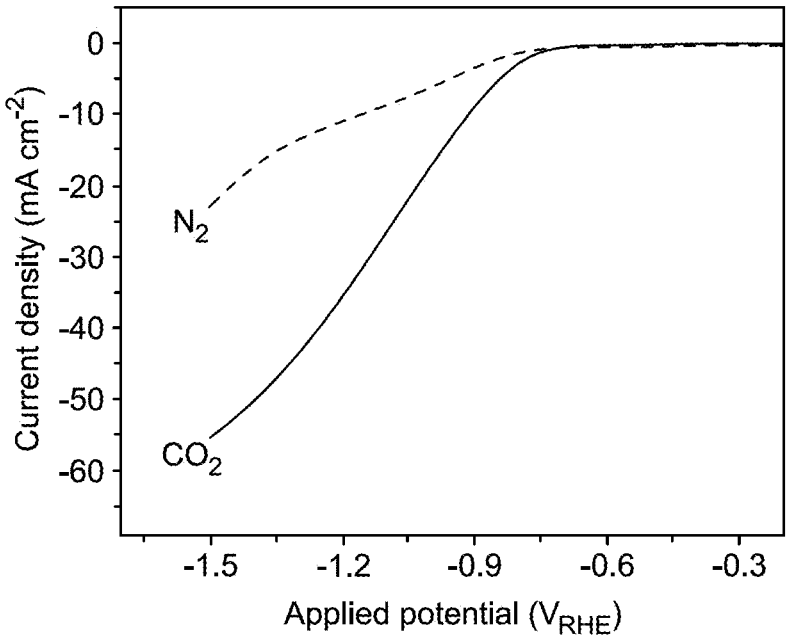
FIG. 6B shows linear sweep voltammograms (LSVs) of Bi-ZIF-8 in $N_2$ saturated and $CO_2$ saturated 0.5 M $KHCO_3$ electrolyte in an H-type cell, according to certain embodiments.

As can be seen in FIG. 6B, linear sweep voltammetry was performed with Bi-ZIF-8 electrocatalyst in a $CO_2$-saturated 0.5 M $KHCO_3$ solution. The results were compared to those obtained with an $N_2$-saturated in the same electrolyte. When the potential was increased, the current density (CD) was found to increase. The electrolyte saturation with carbon dioxide (solid lines) was enhanced three-fold compared to the electrolyte saturation with nitrogen (dashed lines).

Figure 6C:
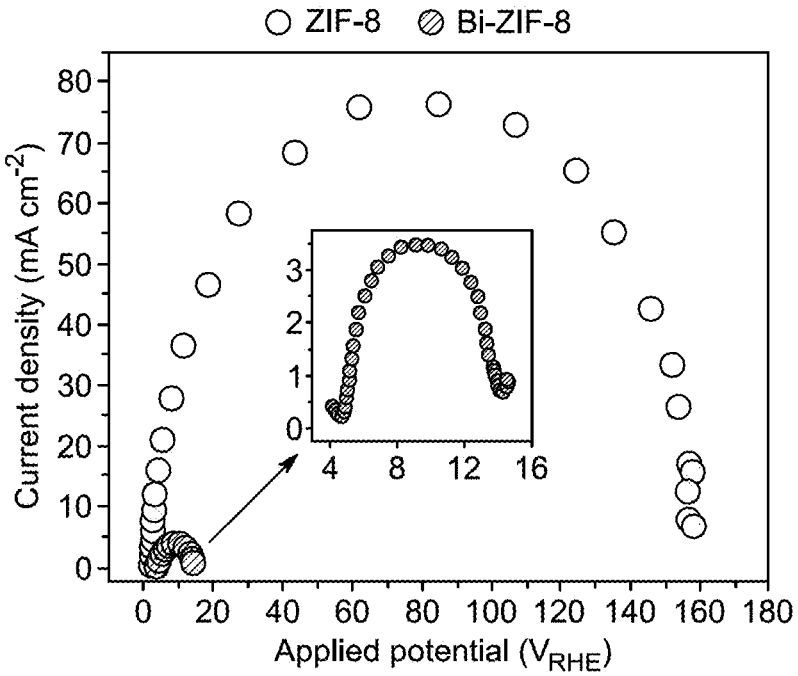
FIG. 6C shows double layer capacitances ($C_{dl}$) of ZIF-8 and Bi-ZIF-8 in an H-type cell, according to certain embodiments.

Electrochemical impedance spectroscopy (EIS), as shown in FIG. 6C, was used to investigate the kinetics of the electrochemical processes. EIS offers insights into the prevailing resistances that govern the processes occurring at the interface between the electrode and electrolyte. Charge transfer resistance ($R_{ct}$) was calculated based on the Nyquist plot. The recorded values for the $R_{ct}$ were 160 and 10 $\Omega cm^2$ for the ZIF-8 and Bi-ZIF-8 electrodes, respectively. The results demonstrate that adding Bi to ZIF-8 improves the charge transfer rate.

Figure 6D:
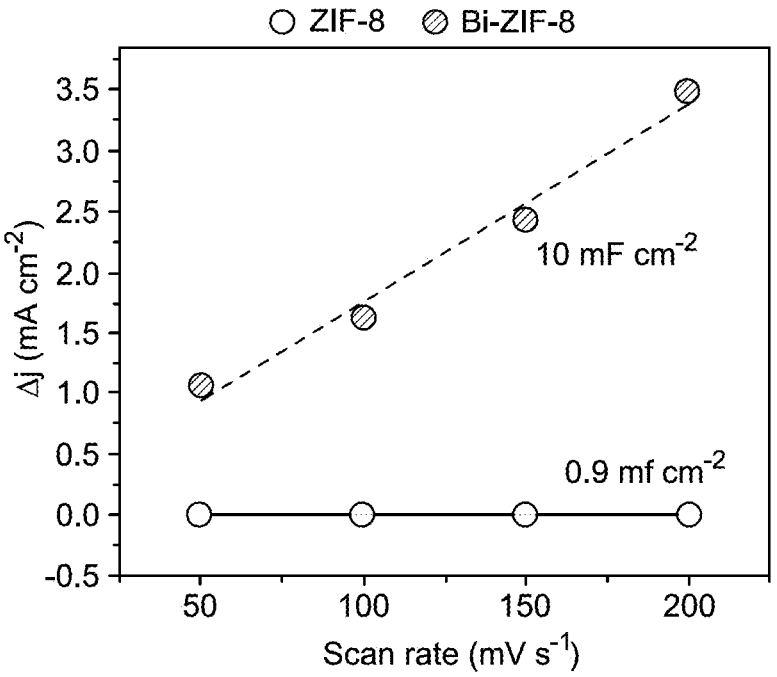
FIG. 6D displays computed slopes derived from cyclic voltammograms (CVs) (FIGS. 7A and 7B) corresponding to double layer capacitances ($C_{dl}$) for ZIF-8 and Bi-ZIF-8 in an H-type cell, according to certain embodiments.
Figure 7A:
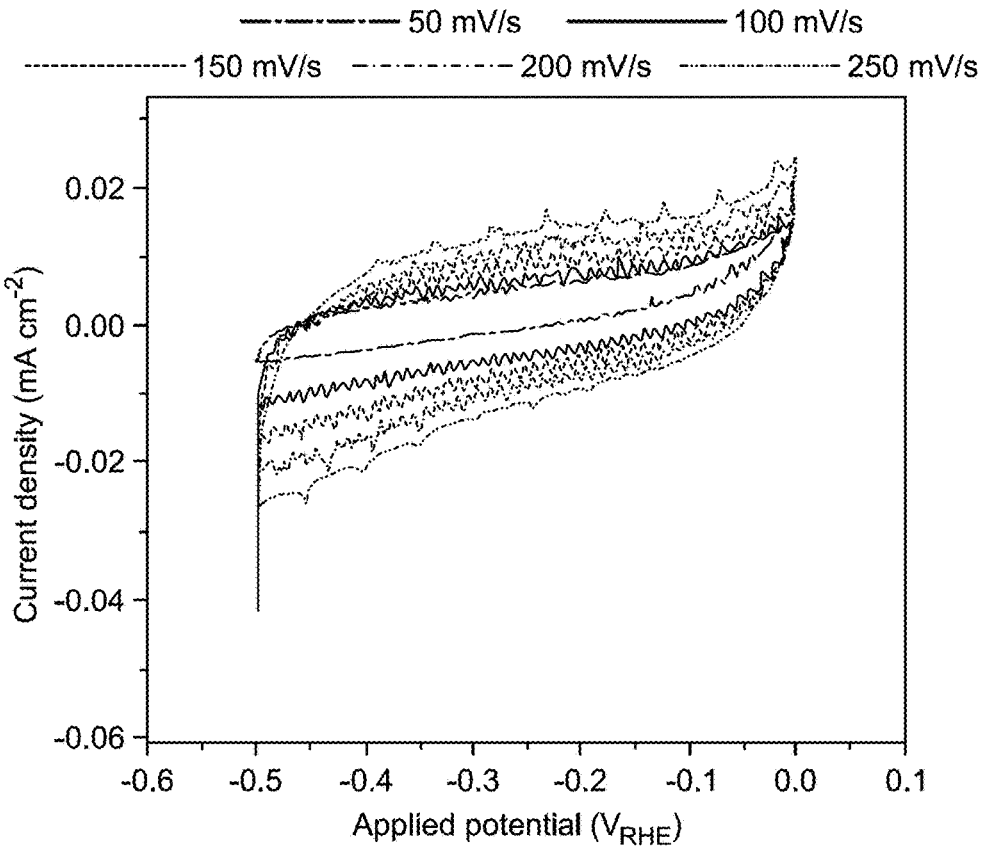
FIG. 7A displays CVs of ZIF-8 at different scan rates in an H-type cell, according to certain embodiments.
Figure 7B:
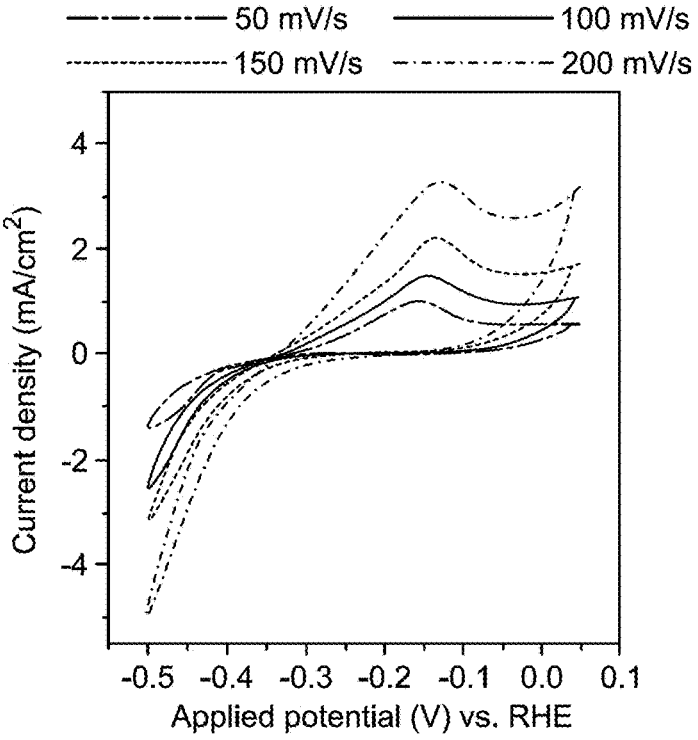
FIG. 7B displays CVs of Bi-ZIF-8 at different scan rates in an H-type cell, according to certain embodiments.

The electrochemical surface area was estimated by computing the double-layer capacitance. Cyclic voltammograms (CVs) were recorded with different scan rates in the capacitive area for the ZIF-8 and Bi-ZIF-8 electrodes are shown in FIG. 7A and FIG. 7B, respectively. FIG. 6D displays the computed slopes derived from the CVs, corresponding to the double-layer capacitances ($C_{dl}$). The ZIF-8 electrode demonstrated a $C_{dl}$ of 0.9 mF $cm^{-2}$. After Bi was added to ZIF-8, the effective electrochemical surface area (ECSA) grew, resulting in a $C_{dl}$ value of 10 mF $cm^{-2}$, as demonstrated in FIG. 6D. An increased ECSA results in more active sites and improved electrochemical performance.

Figure 6E:
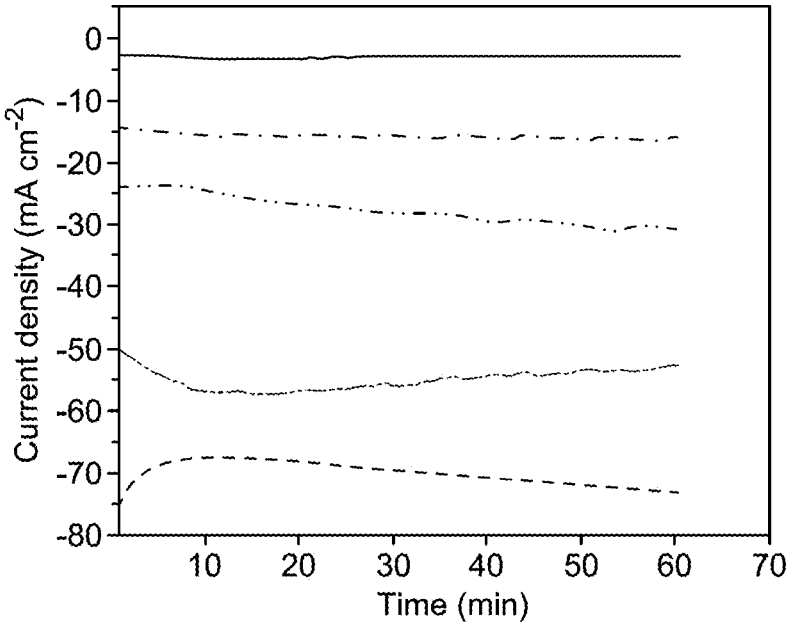
FIG. 6E shows chronoamperometric curves at different potentials (−0.7, −0.9, −1.1, −1.3, and −1.5 V vs. RHE) in an H-type cell, according to certain embodiments.
Figure 6F:
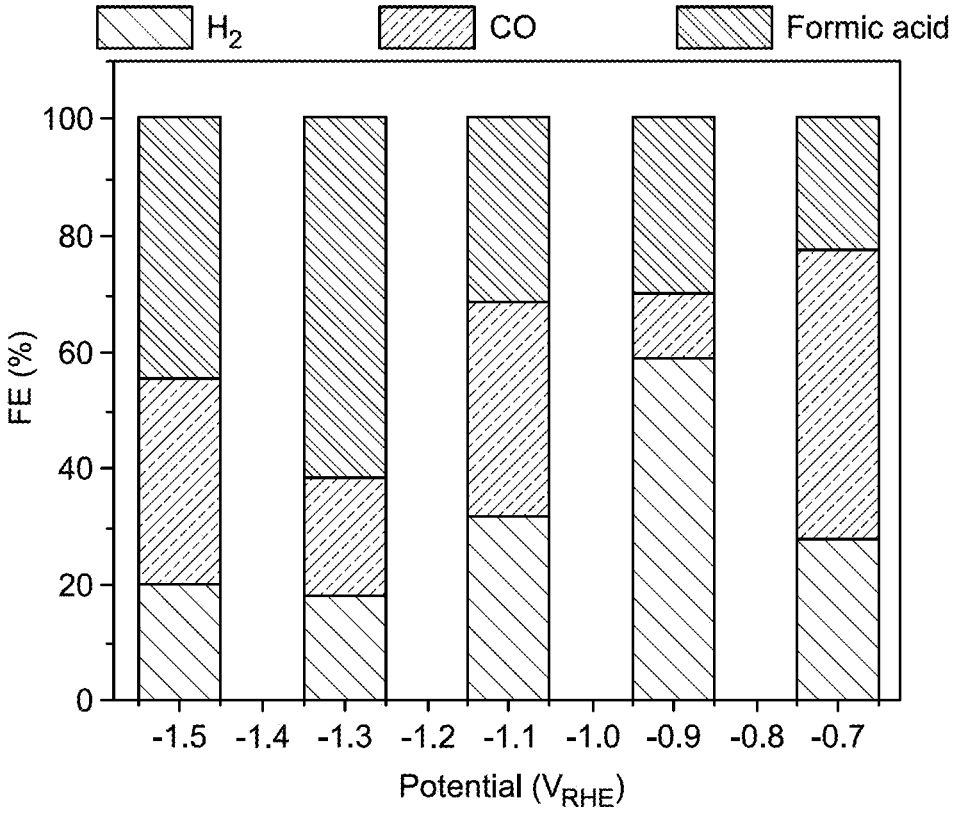
FIG. 6F depicts faradaic efficiency (FE) of hydrogen, carbon monoxide, and formic acid for Bi-ZIF-8 in an H-type cell, according to certain embodiments.
Figure 8:
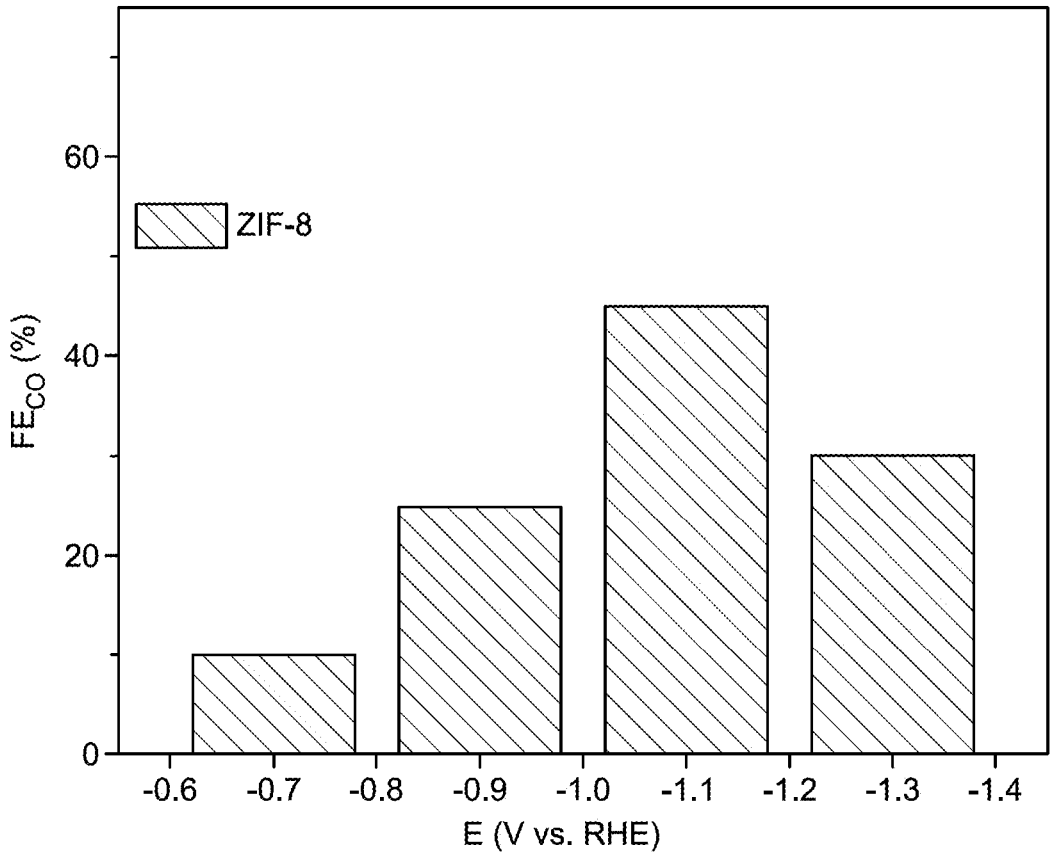
FIG. 8 shows FE of carbon monoxide for ZIF-8 in an H-type cell, according to certain embodiments.

Faradaic efficiency (FE) of the ZIF-8 electrode and Bi-ZIF-8 electrode was measured by conducting chronoamperometry tests for 30 minutes in the H-cell (FIG. 6E), which was connected to the GC-BID to analyze the gaseous products. At the conclusion, a liquid sample was obtained to analyze the liquid products using $^1$H-NMR (water suppression method). Only two gaseous products, $H_2$ and CO, were detected in the case of ZIF-8 (FIG. 8). The ratio of CO grew as the negative potential approached 1.1 V vs. RHE, resulting in a maximum Faradaic efficiency (FE) of 45%; however, beyond this point, the ratio declined due to a rise in the production of $H_2$, resulting from a hydrogen evolution reaction (HER). Following the introduction of bismuth (Bi) into the ZIF-8 framework, formic acid began to be observed as a liquid product alongside gaseous carbon monoxide (CO) and hydrogen ($H_2$) (FIG. 6F.). The concentration of FE(HCOOH) exhibits a positive correlation with the applied potential. The highest observed FE(HCOOH) was 60% when an applied voltage of −1.3 V vs. RHE and obtained a current density of 50 mA $cm^{-2}$.

Figure 9A:
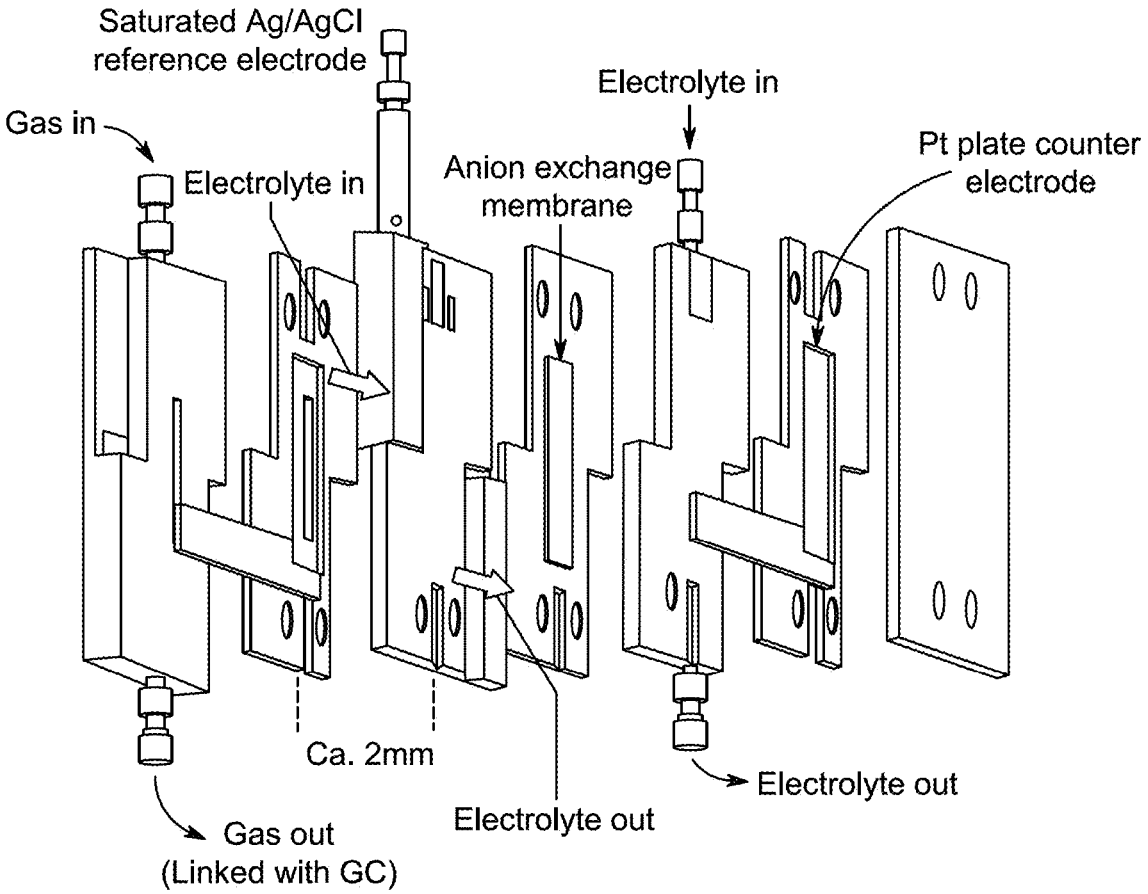
FIG. 9A shows a schematic configuration of a flow cell, according to certain embodiments.
Figure 9B:
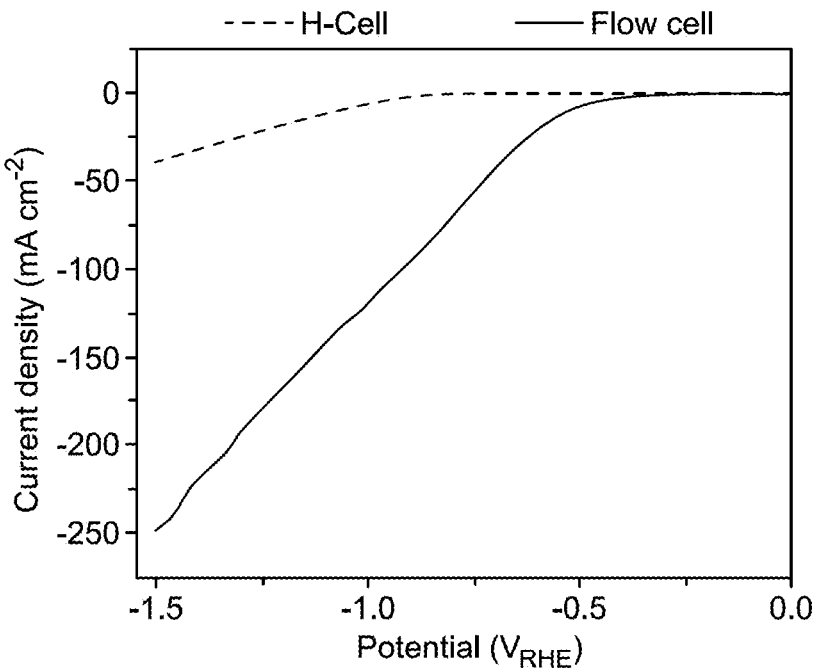
FIG. 9B depicts comparative LSVs of Bi-ZIF-8 in an H-cell and in a flow cell, according to certain embodiments.
Figure 9C:
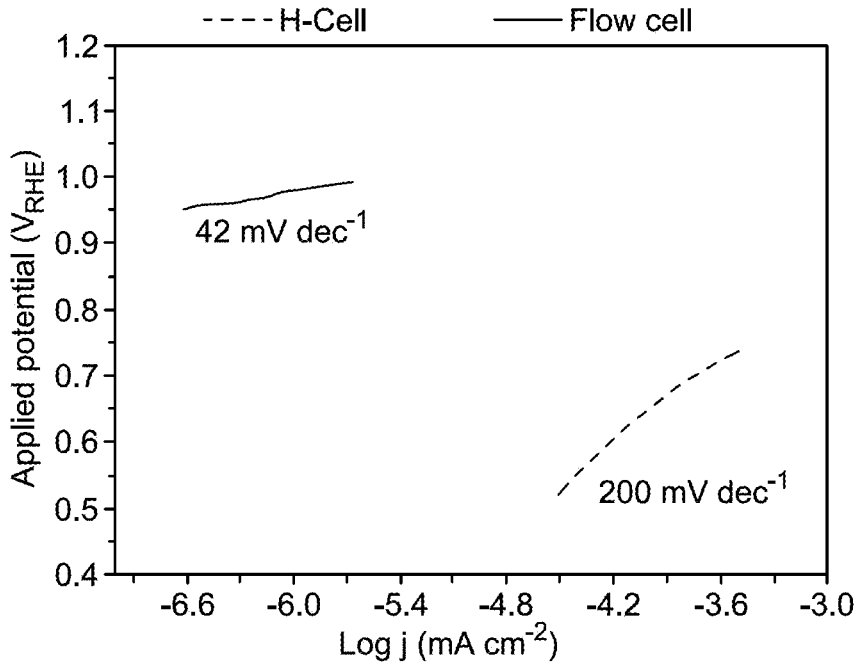
FIG. 9C depicts Tafel slope of ZIF-8 and Bi-ZIF-8 in a flow cell, according to certain embodiments.
Figure 9D:
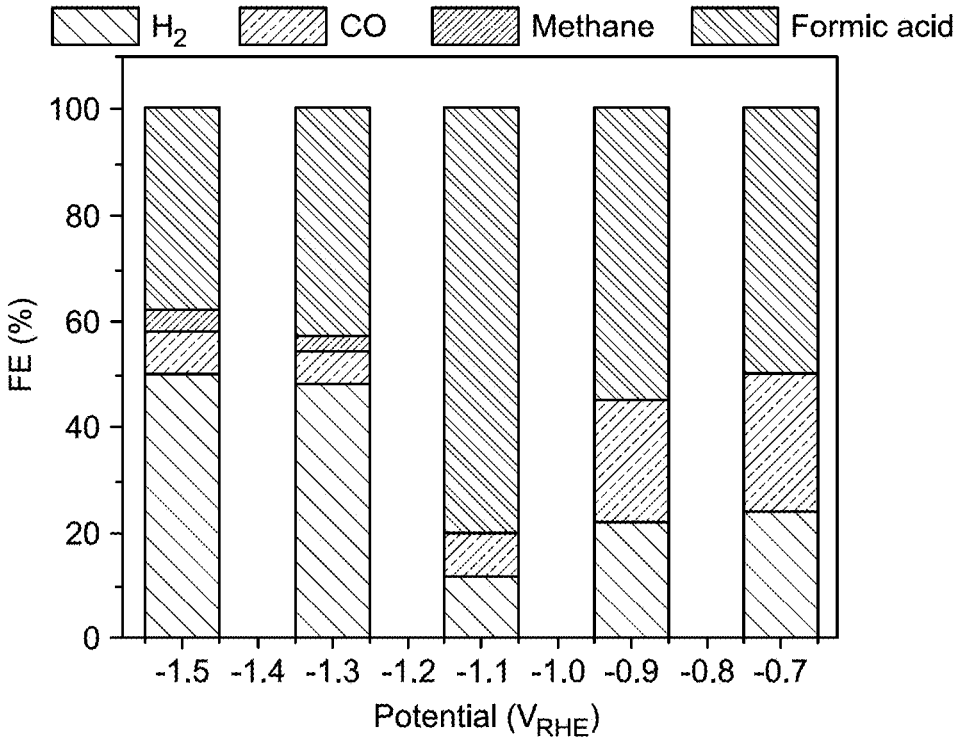
FIG. 9D depicts FE of hydrogen, carbon monoxide, methane, and formic acid for Bi-ZIF-8 using a flow cell, according to certain embodiments.
Figure 9E:
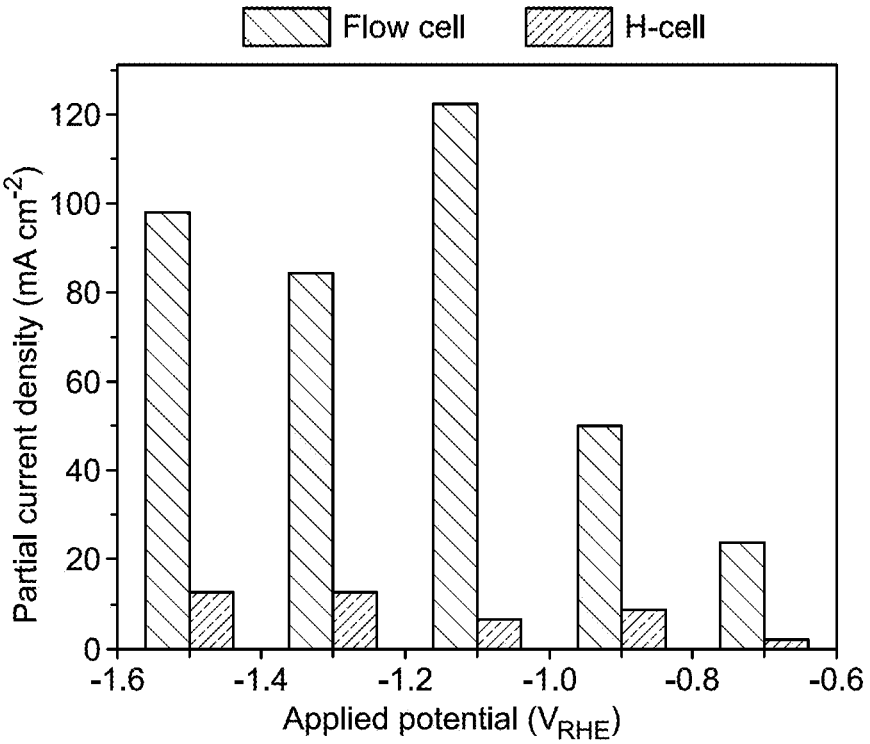
FIG. 9E shows partial current density of formic acid (HCOOH), according to certain embodiments.
Figure 9F:
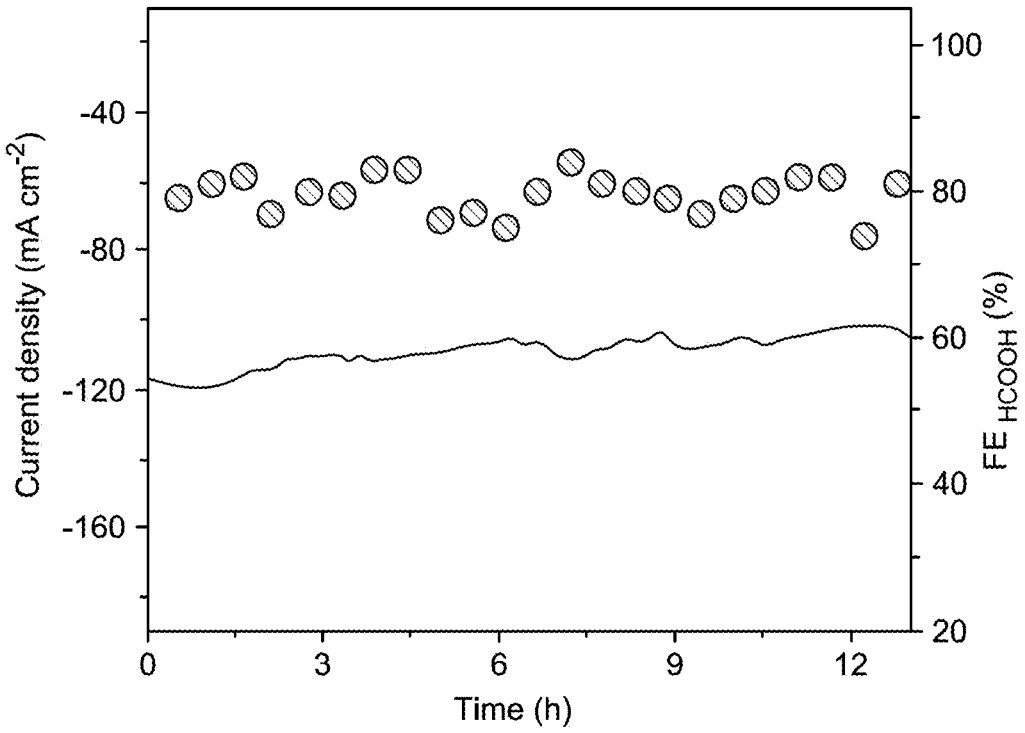
FIG. 9F depicts long-term stability of Bi-ZIF-8 using flow cell, according to certain embodiments.

To investigate the performance of $CO_2$RR at elevated current densities, the composite catalysts were applied onto a gas diffusion layer (GDL) to create gas diffusion electrodes. By utilizing the gas phase, $CO_2$ may diffuse rapidly to the catalytic sites, thereby overcoming the restricted mass transfer in the H-cell. FIG. 9A presents a schematic depiction of the flow cell [Ren, S. et al., Molecular electrocatalysts can mediate fast, selective $CO_2$ reduction in a flow cell, *Science,* 2019, 365, 367, which is incorporated herein by reference in its entirety]. The LSV acquired from the flow cell was compared to the findings obtained from the H-cell. FIG. 9B demonstrates that the current density in the flow cell is greater than that in the H-cell, reaching −250 mA $cm^{-2}$ at a potential of −1.5 V vs. RHE. The Tafel slope in FIG. 9C shows a lower value (42 mV $dec^{-1}$) for Bi-ZIF-8 in the flow cell compared to that in H-cell (200 mV $dec^{-1}$), reflecting faster kinetics in the case of using a flow cell for electrochemical $CO_2$RR [Gu, J. et al., Atomically dispersed $Fe^{3+}$ sites catalyze efficient $CO_2$ electroreduction to CO, *Science,* 2019, 364, 1091; and T. Gao, T. et al., Construction of hydrophilic-hydrophobic domains in $Bi_2O_3$/nitrogen-doped carbon electrode to boost $CO_2$-to-formate conversion, *Electrochim Acta,* 2019, 305, 388, which are incorporated herein by references in their entireties]. Analysis of the products in the flow cell was also examined at various applied potentials (FIG. 9D). The primary products seen were CO, $H_2$, and HCOOH, similar to those produced by the H-cell. In addition, minute quantities of methane were detected at −1.3 and −1.5 V vs. RHE. In comparison to the H-cell, the flow cell achieved a FE of HCOOH of 80% at a lower applied potential of −1.1 V vs. RHE. Additionally, the flow cell exhibited a three-fold increase in current density, reaching −150 mA $cm^{-2}$. The partial current density (PCD) of HCOOH was calculated in FIG. 9E for Bi-ZIF-8 for the H cell and the flow cell. In the case of the H cell, the highest PCD was 10 mA $cm^{-2}$ at a potential of −1.5 V vs. RHE, while the PCD in the case of the flow cell reached 120 mA $cm^{-2}$ at a potential of −1.1 V vs. RHE, which shows more current is being utilized for the $CO_2$ reduction to formic acid compared to HER process. The long-term stability was investigated in the flow cell for 16 hours while measuring the HCOOH FE and the stability test (FIG. 9F).

Figure 10A:
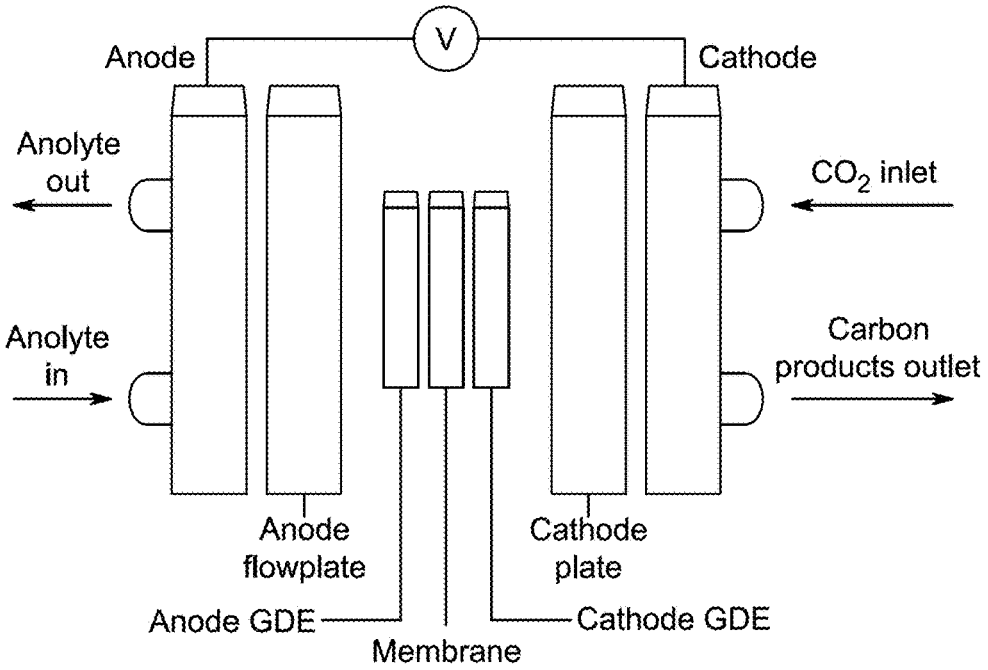
FIG. 10A depicts a zero-gap membrane electrode assembly (MEA), according to certain embodiments.
Figure 10B:
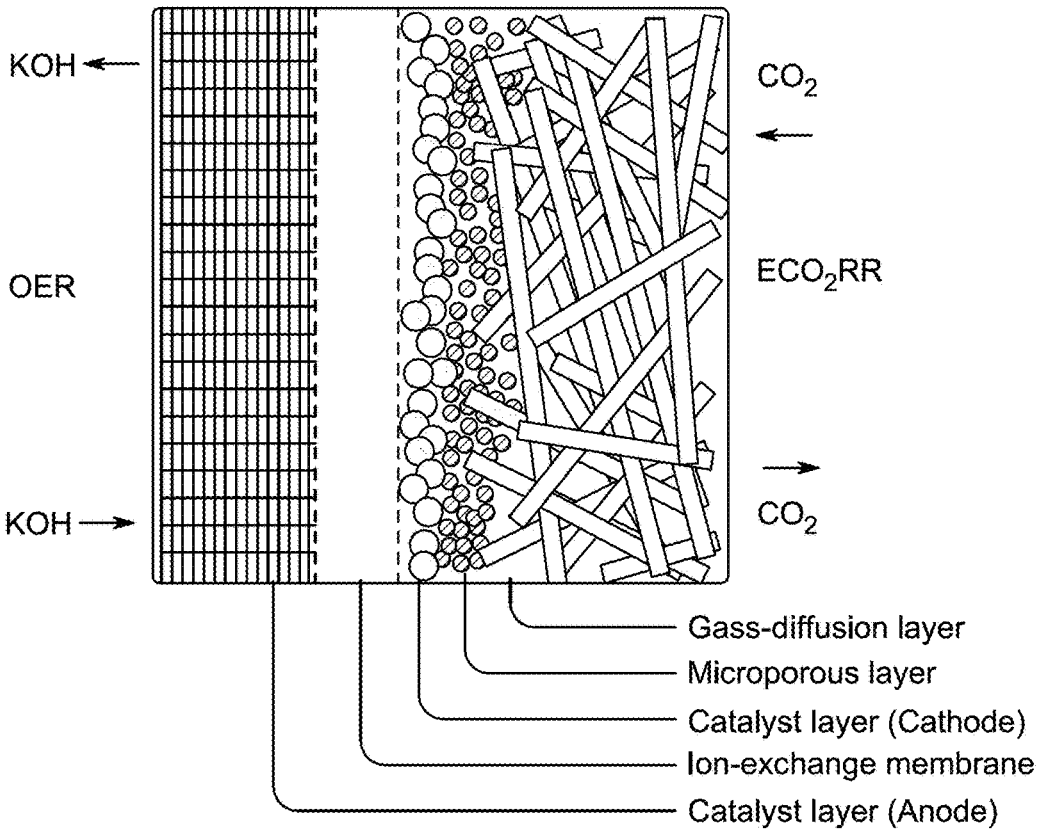
FIG. 10B depicts a schematic figure of a zero-gap MEA cell, according to certain embodiments.
Figure 10C:
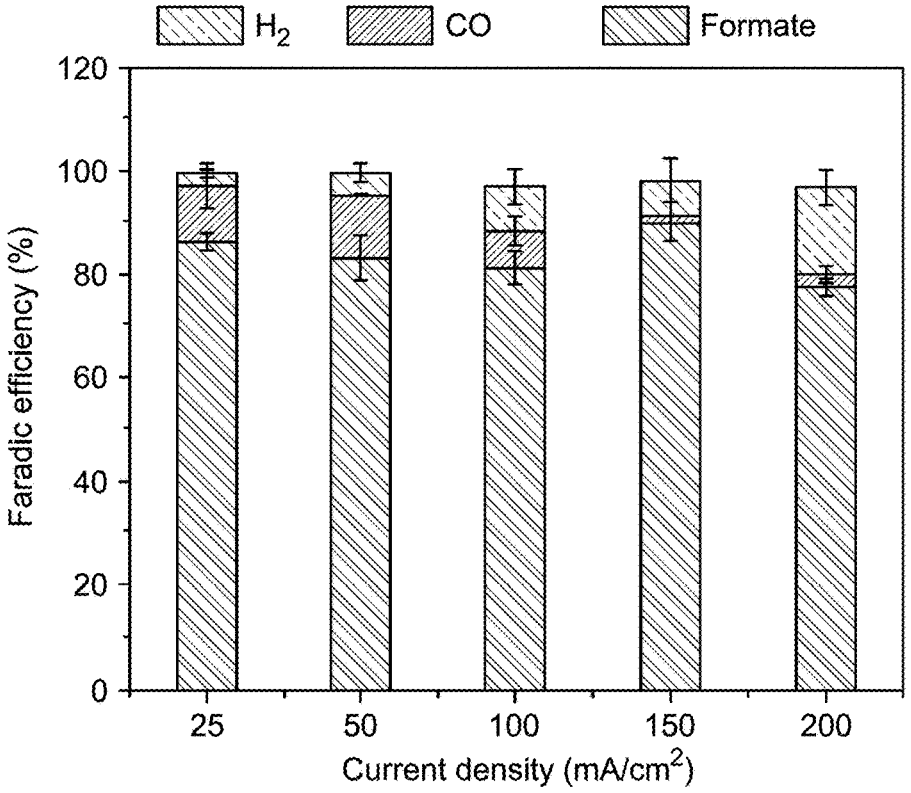
FIG. 10C depicts FE of hydrogen, carbon monoxide, and formate for Bi-ZIF-8 using an MEA cell, according to certain embodiments.
Figure 10D:
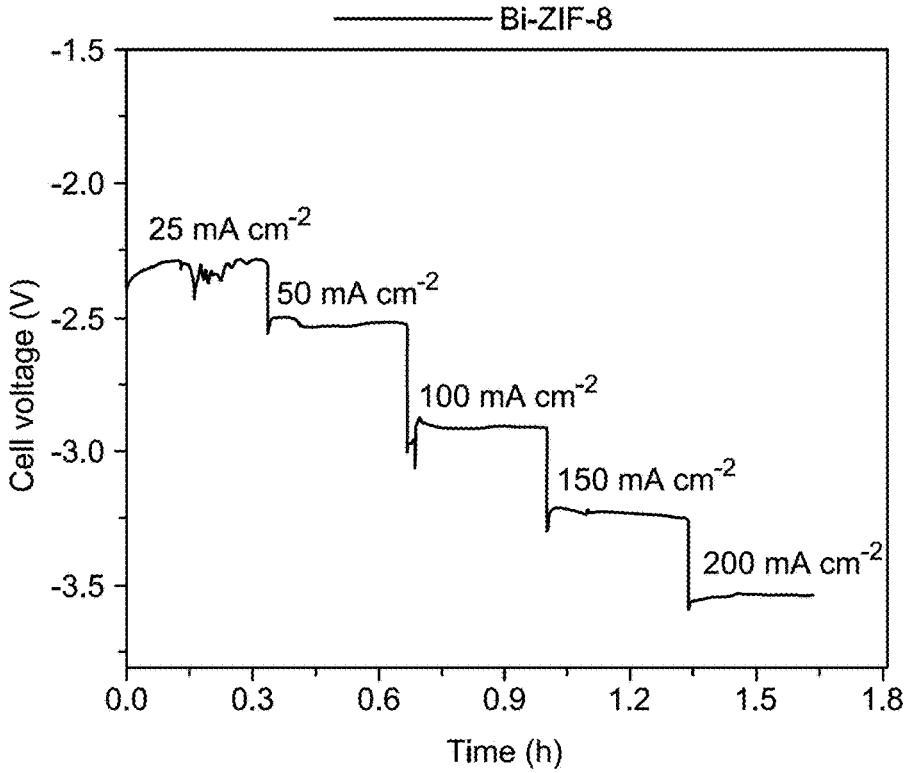
FIG. 10D shows stepwise stability at different current densities of Bi-ZIF-8 using an MEA cell, according to certain embodiments.
Figure 10E:
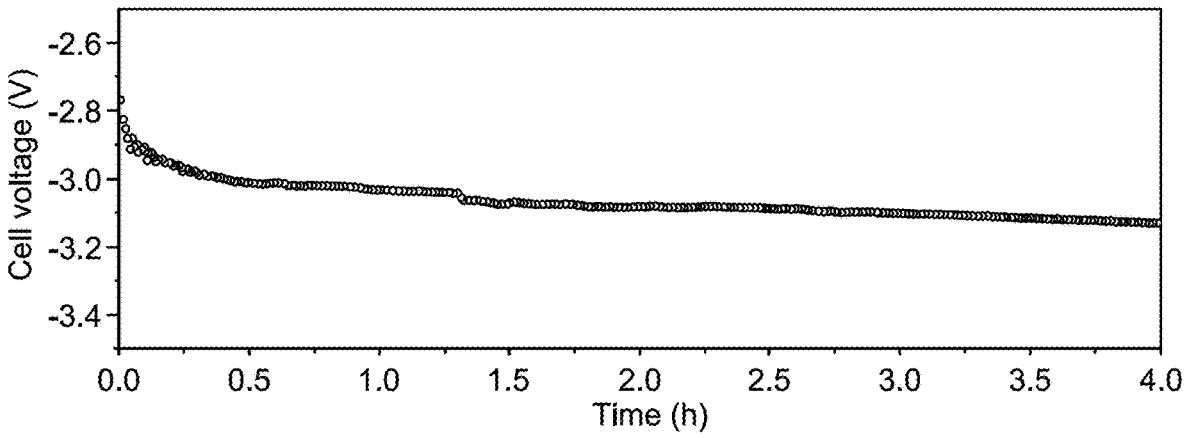
FIG. 10E depicts long-term stability of Bi-ZIF-8 using an MEA cell, according to certain embodiments.
Figure 11:
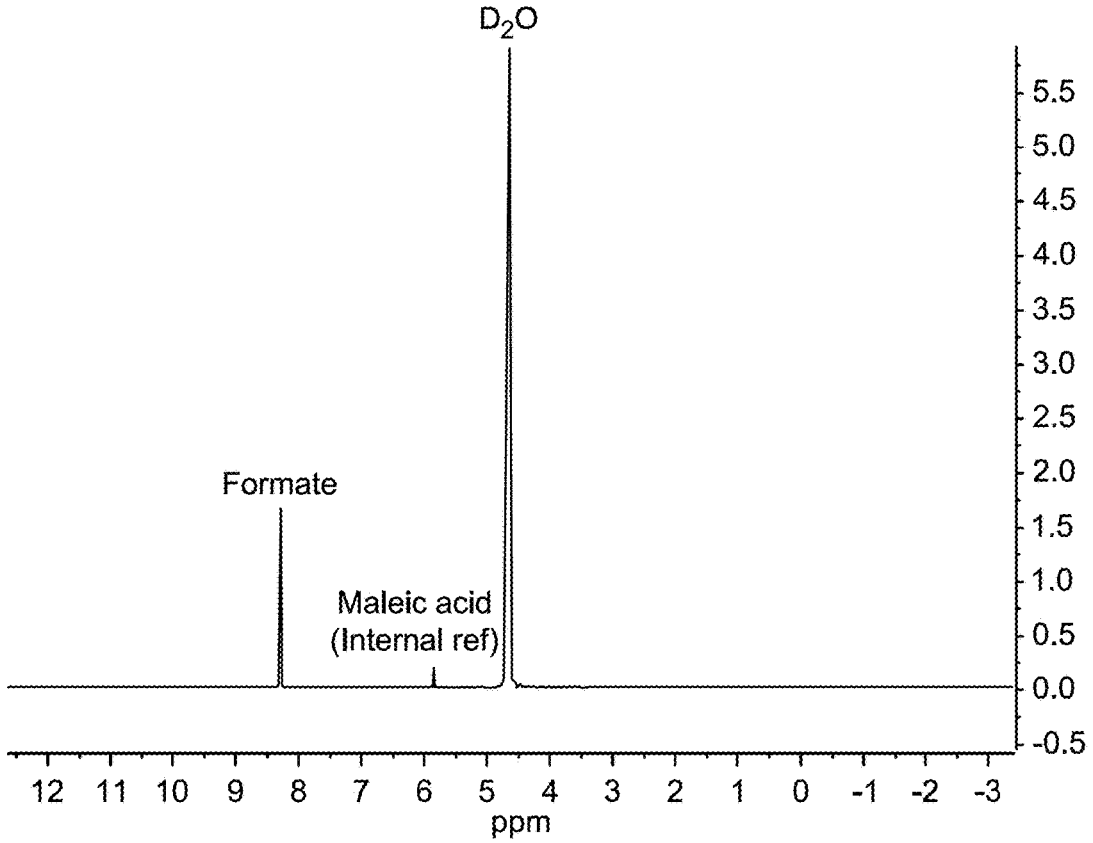
FIG. 11 is a nuclear magnetic resonance (NMR) spectrum of electrochemical $CO_2$RR products of Bi-ZIF-8 using a flow cell at an applied potential of −1.1 V vs RHE, according to certain embodiments.

The zero-gap membrane electrode assembly (MEA), as shown in FIG. 10A, provides a method for $CO_2$ reduction unlike conventional H cells and flow cells that use a liquid catholyte and anolyte. Conventional systems frequently face restrictions due to low solubility of $CO_2$ in water-based solutions and limited access to active sites. This is observed in the performance differences between H cells and flow cells. The MEA configuration consists of an anode chamber containing a liquid-phase anolyte, which is positioned next to a cathode chamber with a gas-phase intake. In the MEA, a stream of $CO_2$ that has been humidified is passed directly to the active materials through a serpentine flow channel located behind the GDE (FIG. 10B). During the evaluation of the catalytic performance of Bi-ZIF-8 in the MEA cell, experiments were conducted at current densities ranging from 25 to 200 mA/$cm^2$ (FIG. 10D). The cell potential at each density was determined by applying currents progressively. Including both Bi and ZIF-8 in the MEA configuration reduces cell potential, highlighting the catalytic synergy achieved by combining them. The Bi-ZIF-8 catalyst shows similar CO selectivity to those seen in H cells and flow cells (FIG. 10C); however, there is a slight decrease in hydrogen evolution reaction (HER) rates due to the lower operating voltages and earlier onset potential in MEA setups, reaching formic acid FE 91% at a current density of 150 mA $cm^2$.

Table 1 compares the work of the current disclosure with reported bismuth-based catalysts for $CO_2$ conversion. The high dispersion of BiNP on ZIF-8 achieved in the current work achieves high current density compared to the reported literature.

TABLE 1

Comparison of the work with literature

| Electrocatalyst | Electrolytes | Type of cell | Potential (V vs. RHE) | FE (%) | CD (mA $cm^{-2}$) | References |
|---|---|---|---|---|---|---|
| Bi | 0.5M $KHCO_3$ | H Cell | −1.6 | 98 | 9.7 | 1 |
| BiOCl | 0.5M $KNCO_3$ | H Cell | −1.5 | 92 | 3.7 | 2 |
| Bi—O | 0.5M $KHCO_3$ | H Cell | −0.9 V | 91 | 8 | 3 |
| Bi—Sn | — | H Cell | −1 | 93.9 | 9.3 | 4 |
| Bi-NRs@NCNTs | 0.1M $KHCO_3$ | H Cell | −0.9 | 90.9 | 6 | 5 |
| Zn | K2$CO_3$ | H Cell | −1.5 | 38.2 | — | 6 |
| $Bi_2O_3$-NGQDs | 0.5M $KHCO_3$ | H Cell | −0.7 | 98.1 | 18.1 | 7 |
| $Bi_2O_3$NSs@MCCM | 0.1M $KHCO_3$ | H Cell | −1.25 | 93.8 | 6 | 8 |
| Bi/Cu foam | 0.1M $KHCO_3$ | H Cell | −1 | 92 | 10 | 9 |
| Bi—PMo nanosheets | 0.5M $NaHCO_3$ | H Cell | −0.86 | 93 ± 2 | 30 | 10 |
| Bimuthene | 1M KOH | Flow cell | −0.75 | 99 | 200 | 11 |
| defective $\beta Bi_2O_3$ | 1M KOH | Flow cell | −0.58 | 95-98 | 210 | 12 |
| Bi microparticles | 1M KOH | Flow cell | −1.1 | >95 | 271.7 | 13 |
| Bi-ZIF-8 | 0.5M $KHCO_3$ | H Cell | −1.3 | 62 | 50 | This work |

TABLE 1-continued

Comparison of the work with literature

| Electrocatalyst | Electrolytes | Type of cell | Potential (V vs. RHE) | FE (%) | CD (mA $cm^{-2}$) | References |
|---|---|---|---|---|---|---|
| Bi-ZIF-8 | 1M KOH | Flow cell | −1.1 | 80 | 120 | This work |
| Bi-ZIF-8 | 1M KOH | MEA cell | −1.1 | 91 | 150 | This work |

[1] Qiu, Y. et al., Selective conversion of $CO_2$ to formate on a size tunable nano-Bi electrocatalyst, *Journal of CO2 Utilization*, 2017, 20, 328;
[2] Zhang, H. et al., Selective electro- reduction of $CO_2$ to formate on nanostructured Bi from reduction of BiOCl nanosheets, *Electrochem commun*, 2014, 46, 63;
[3] Deng, P. et al., Bismuth Oxides with Enhanced Bismuth- Oxygen Structure for Efficient Electrochemical Reduction of Carbon Dioxide to Formate, *ACS Catal*, 2020, 10, 743;
[4] Wu, Z. et al., Engineering Bismuth-Tin Interface in Bimetallic Aerogel with a 3D Porous Structure for Highly Selective Electrocatalytic $CO_2$ Reduction to HCOOH, *Angewandte Chemie International Edition*, 2021, 60, 12554;
[5] Zhang, W. et al., Nanocapillarity and Nanoconfinement Effects of Pipet-like Bismuth@Carbon Nanotubes for Highly Efficient Electrocatalytic $CO_2$ Reduction, *Nano Lett*, 2021, 21, 2650;
[6] Yadav, V. S. K. and Purkait, M. K., Electrochemical reduction of $CO_2$ to HCOOH using zinc and cobalt oxide as electrocatalysts, *New Journal of Chemistry*, 2015, 39, 7348;
[7] Liu, S. et al., Nitrogen-Doped Graphene Quantum Dots Enhance the Activity of $Bi_2O_3$ Nanosheets for Electrochemical Reduction of $CO_2$ in a Wide Negative Potential Region, *Angewandte Chemie International Edition*, 2018, 57, 12790;
[8] Liu, S. et al., $Bi_2O_3$ Nanosheets Grown on Multi-Channel Carbon Matrix to Catalyze Efficient $CO_2$ Electroreduction to HCOOH, *Angewandte Chemie International Edition*, 2019, 58, 13828;
[9] An, X. et al., The in situ morphology transformation of bismuth-based catalysts for the effective electroreduction of carbon dioxide, *Sustain Energy Fuels*, 2020, 4, 2831;
[10] Guo, S. X. et al., Phosphomolybdic Acid-Assisted Growth of Ultrathin Bismuth Nanosheets for Enhanced Electrocatalytic Reduction of $CO_2$ to Formate, *ChemSusChem*, 2019, 12, 1091;
[11] Cao, C. et al., Metal-Organic Layers Leading to Atomically Thin Bismuthene for Efficient Carbon Dioxide Electroreduction to Liquid Fuel, *Angewandte Chemie International Edition*, 2020, 59, 15014;
[12] Gong, Q. et al., Structural defects on converted bismuth oxide nanotubes enable highly active electrocatalysis of carbon dioxide reduction, *Nat Commun*, 2019, 10, 2807; and [13] Lin, C. et al., Electrodeposited highly-oriented bismuth microparticles for efficient $CO_2$ electroreduction into formate, *Nano Res*, 2022, 15, 10078, which are incorporated herein by references in their entireties.

Immobilization of bismuth nanoparticles (BNP) onto ZIF-8 with high-concentration crystals is a method for raising effectiveness of electrochemical $CO_2$ reduction reactions ($CO_2$RR). In various cell applications, the synthesized BNP-doped ZIF-8 electrocatalysts achieved up to 91% Faradaic efficiency (FE), demonstrating selectivity towards formate generation and highlighting the use of employing metal-organic frameworks (MOFs) as electrocatalysts because of their large surface area, adaptable pores, and flexible structure. The increased catalytic activity and selectivity in the $CO_2$RR process are due to these characteristics. Spectroscopic and electrochemical evaluation of the synthesized electrocatalysts highlighted relationships between their catalytic performance and structural characteristics, and supporting their efficacy in $CO_2$ conversion. Using an all-solid-state electrolyte cell has made it possible to continuously produce formic acid at a high concentration and purity level that is almost 100% by weight. This accomplishment is a step towards the efficient and sustainable use of $CO_2$ to synthesize liquid fuels. The present disclosure highlights MOF-based electrocatalysts and their potential to speed up the electrochemical conversion of $CO_2$ to liquid fuels for mitigating climate change and accelerating the development of sustainable energy systems.

Numerous modifications and variations of the present disclosure are possible in light of the above teachings. It is therefore to be understood that within the scope of the appended claims, the disclosure may be practiced otherwise than as specifically described herein.

The invention claimed is:

1. A bismuth-zinc material, comprising:
bismuth nanodots; and
a zeolitic imidazolate framework-8,
wherein the bismuth nanodots are dispersed on the zeolitic imidazolate framework-8,
wherein the bismuth-zinc material is in the form of particles with a longest dimension of 200 to 1000 nm,
wherein bismuth is present in an amount of 7 to 8 percent by weight based on a total weight of the bismuth-zinc material,
wherein zinc is present in an amount of 9 to 10 percent by weight based on a total weight of the bismuth-zinc material.

2. The bismuth-zinc material of claim 1, wherein the material is made by a process comprising:
dissolving a zinc salt in water to form a zinc solution;
dissolving a bismuth salt in water to form a bismuth solution;
dissolving 2-methylimidazole in water to form a ligand solution;
mixing the zinc solution and the bismuth solution to form a metal solution;
mixing the ligand solution and the metal solution;
adding a base and stirring; and
collecting the formed bismuth-zinc material.

3. A method of carbon dioxide reduction, comprising:
contacting a working electrode comprising the bismuth-zinc material of claim 1, a reference electrode, and a counter electrode with an aqueous solution in a cell;
applying a potential; and
reducing carbon dioxide at the working electrode.

4. The method of claim 3, wherein the working electrode further comprises a carbon paper and a sulfonated tetrafluoroethylene-based fluoropolymer-copolymer.

5. The method of claim 4, wherein the working electrode is made by a process comprising:
dispersing the bismuth-zinc material, the sulfonated tetrafluoroethylene-based fluoropolymer-copolymer, a polar solvent in water to form a mixture;
sonicating the mixture for 10 to 30 minutes; and
depositing the mixture onto the carbon paper.

6. The method of claim 3, wherein the reference electrode is a silver/silver chloride (Ag/AgCl) electrode.

7. The method of claim 3, wherein the counter electrode is a platinum mesh.

8. The method of claim 3, wherein the aqueous solution comprises potassium bicarbonate.

9. The method of claim 3, wherein the aqueous solution comprises potassium hydroxide.

10. The method of claim 3, wherein the cell is an H-type cell, and the working electrode has a Faradaic efficiency of 50 to 70% for formic acid conversion from carbon dioxide based on an initial amount of carbon dioxide at a potential of −1.3 V vs. RHE and a current density of 50 mA/cm$^2$.

11. The method of claim 3, wherein the cell is an H-type cell, and the working electrode has a Faradaic efficiency of 40 to 50% for formic acid conversion from carbon dioxide based on an initial amount of carbon dioxide at a potential of −1.5 V vs. RHE.

12. The method of claim 3, wherein the cell is an H-type cell, and the working electrode has a Faradaic efficiency of 40 to 60% for carbon monoxide conversion from carbon dioxide based on an initial amount of carbon dioxide at a potential of −0.7 V vs. RHE.

13. The method of claim 3, wherein the cell is a flow cell, and the working electrode has a Faradaic efficiency of 75 to 85% for formic acid conversion from carbon dioxide based on an initial amount of carbon dioxide at a potential of −1.1 V vs. RHE and a current density of 120 mA/cm$^2$.

14. The method of claim 3, wherein the cell is a membrane electrode assembly (MEA) cell, and the working electrode has a Faradaic efficiency of 85 to 95% for formic acid conversion from carbon dioxide based on an initial amount of carbon dioxide at a potential of −1.1 V vs. RHE and a current density of 150 mA/cm$^2$.

15. The method of claim 3, wherein the working electrode has a charge transfer resistance of 5 to 15 Ω/cm$^2$.

16. The method of claim 3, wherein the working electrode has a double layer capacitance of 5 to 15 mF/cm$^2$.

17. The method of claim 3, wherein the cell is a flow cell, and the working electrode has a Tafel slope of 30 to 50 mV/dec.

18. The method of claim 3, wherein the cell is an H-type cell, and the working electrode has a current density of −70 to −50 mA/cm$^2$ at a potential of −1.5 V vs. RHE.

19. The method of claim 3, wherein the cell is a flow cell, and the working electrode has a current density of −260 to −240 mA/cm$^2$ at a potential of −1.5 V vs. RHE.

20. The method of claim 3, wherein the cell is a flow cell, and the working electrode is stable for 10 to 18 hours at a current density of −120 mA/cm$^2$.

* * * * *